US008152394B2

(12) United States Patent
Kohira et al.

(10) Patent No.: US 8,152,394 B2
(45) Date of Patent: Apr. 10, 2012

(54) PRINTER WITH A CUTTER HAVING A PUSHING PORTION FOR MOVING THE FIXED BLADE AWAY FROM THE MOVABLE BLADE

(75) Inventors: Hiroyuki Kohira, Chiba (JP); Toshiharu Itakura, Chiba (JP)

(73) Assignee: Seiko Instruments Inc. (JP)

( * ) Notice: Subject to any disclaimer, the term of this patent is extended or adjusted under 35 U.S.C. 154(b) by 469 days.

(21) Appl. No.: 12/456,331

(22) Filed: Jun. 15, 2009

(65) Prior Publication Data

US 2009/0317163 A1 Dec. 24, 2009

(30) Foreign Application Priority Data

Jun. 18, 2008 (JP) ..... 2008-159548

(51) Int. Cl.
*B41J 11/70* (2006.01)

(52) U.S. Cl. ..... 400/621; 83/563; 83/564

(58) Field of Classification Search ..... 400/621; 83/563, 564

See application file for complete search history.

(56) References Cited

U.S. PATENT DOCUMENTS

| | | | | |
|---|---|---|---|---|
| 6,899,479 | B2 * | 5/2005 | Hayashi et al. | 400/621 |
| 6,988,843 | B2 * | 1/2006 | Song | 400/621 |
| 7,547,154 | B2 * | 6/2009 | Kawaguchi | 400/621 |
| 2006/0230956 | A1 | 10/2006 | Yoshioka | |
| 2007/0175307 | A1 * | 8/2007 | Ito | 83/583 |
| 2009/0245915 | A1 * | 10/2009 | Kawaguchi | 400/621 |
| 2010/0202819 | A1 * | 8/2010 | Shirotori et al. | 400/621 |

FOREIGN PATENT DOCUMENTS

| | | | |
|---|---|---|---|
| EP | 1445113 | | 8/2004 |
| JP | 06262587 | A * | 9/1994 |
| JP | 11198469 | A * | 7/1999 |
| JP | 200675935 | | 3/2006 |
| JP | 2008100530 | | 5/2008 |

* cited by examiner

*Primary Examiner* — Daniel J Colilla
(74) *Attorney, Agent, or Firm* — Adams & Wilks

(57) ABSTRACT

In order to reliably and promptly release bite of a fixed blade and a movable blade with a simple manipulation without being influenced by a state of paper jam of a recording sheet, provided is a printer capable of performing printing on a recording sheet and then cutting the same, including: a fixed blade (11); a movable blade (30); a movable blade drive system (31) including a rack (40) attached to the movable blade, and a rack gear (42) which gears with the rack, rotates in accordance with rotation of a drive gear (41) coupled to a forward/reverse rotatable motor, and linearly moves the rack; a manipulatable lever portion (32); a cooperative mechanism (13) including a pushing portion (12) for moving the fixed blade in a direction of moving away from the movable blade in conjunction with manipulation of the lever portion, and for releasing a contacting pressure of both the blades; a first unit mainly incorporating the fixed blade and the cooperative mechanism; and a second unit (4) mainly incorporating the movable blade and the movable blade drive system, in which one of both the units is separable from another unit, and combination is released.

12 Claims, 22 Drawing Sheets

FIG. 22A
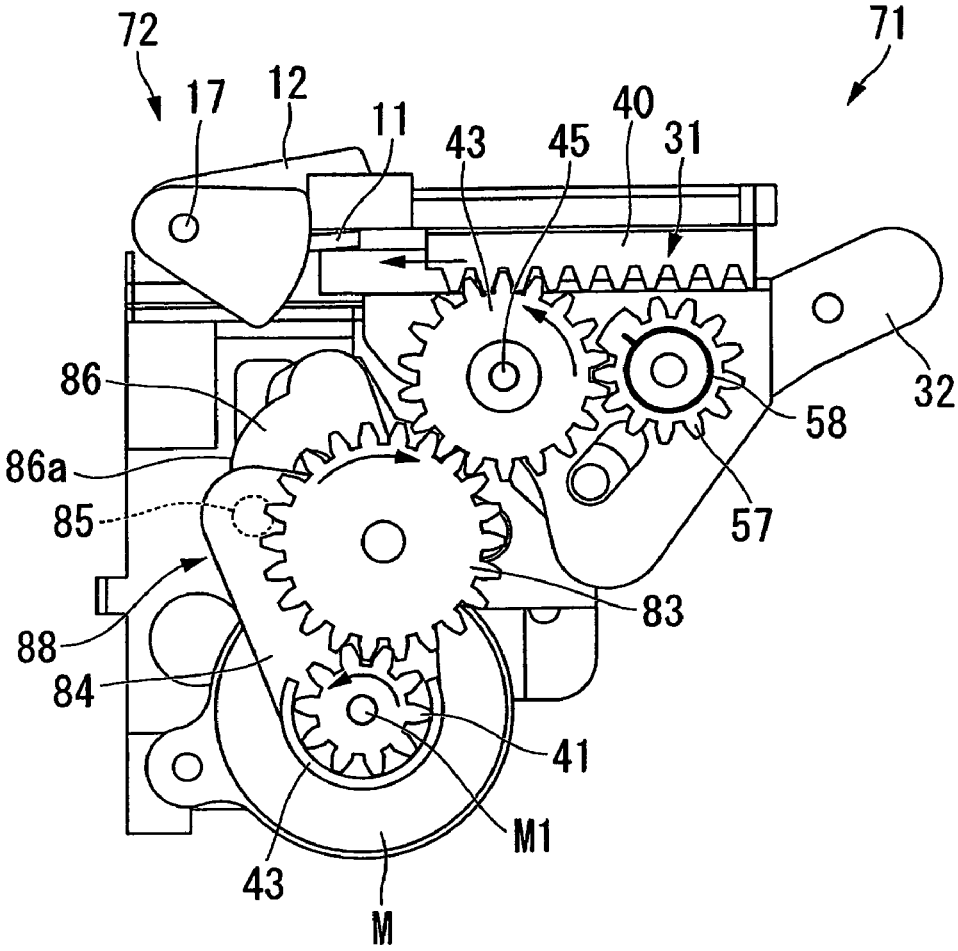
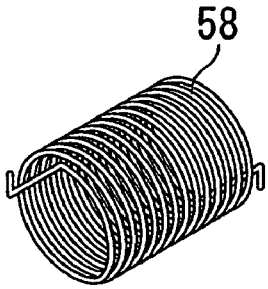
FIG. 22B

PRINTER WITH A CUTTER HAVING A PUSHING PORTION FOR MOVING THE FIXED BLADE AWAY FROM THE MOVABLE BLADE

BACKGROUND OF THE INVENTION

1. Field of the Invention

The present invention relates to a printer with a cutter capable of appropriately cutting a recording sheet after printing on the recording sheet pulled out from a paper roll.

2. Description of the Related Art

Nowadays, a great number of various types of thermal printers, which performs printing by pressing a heated thermal head against a special recording sheet that changes color when heat is applied thereto, are provided. In particular, use is suitably made in printing of various labels, receipts, tickets, and the like because smooth character printing and colorful graphic printing are possible without using toner, ink, and the like.

As represented by the thermal printers, numerous printers with a cutter provided with a cutter mechanism for cutting the printed recording sheet are known. The cutter mechanism is normally set (auto cutter) to automatically cut the recording sheet when printing is terminated, and hence the cut recording sheet can be immediately used for a receipt, a ticket, and the like, as mentioned above.

The printer with a cutter is used by being incorporated in, for example, a cash register, a mobile terminal device, and the like.

The cutter mechanism is typically configured by a fixed blade and a movable blade that is slidable. When cutting the recording sheet, the movable blade is slid so as to ride on the upper surface of the fixed blade. Both the blades then sandwich and cut the recording sheet as if a pair of scissors.

The fixed blade is configured to have the root side supported by a hinge portion, and the cutting edge side to be swingable, and is biased to be pushed upward by a biasing portion such as a coil spring. Thus, when the movable blade slides, both the blades are brought into contact with each other at an appropriate contacting pressure. As a result, the recording sheet can be cut neatly.

However, the fixed blade and the movable blade often bite each other due to the jam of the recording sheet when cutting the recording sheet. For instance, the recording sheet enters and gets between the fixed blade and the movable blade, thereby regulating the swinging of the fixed blade and causing bite.

If such bite occurs, the printing needs to be interrupted and the recovery task needs to be immediately carried out. The bite needs to be recovered as fast as possible in order to promptly return to the printing task.

The configuration of a typical movable blade and fixed blade is described here with reference to the drawings.

As illustrating in FIG. 30A, a fixed blade 100 and a movable blade 101 are arranged on a downstream side of a conveying direction of the recording sheet with respect to a platen roller 102 for feeding a recording sheet P, and a print head 103 arranged so as to face the platen roller 102, for printing on the recording sheet P. The movable blade 101 is coupled to a motor (not shown) through an intermediation of a gear train mechanism 104 so as to slidably move closer to or move away from the fixed blade 100 by driving the motor. The gear train mechanism 104 is mainly configured by a worm gear 104*a*, coupled to a shaft of the motor, and a linear movement mechanism 104*b* including a plurality of gears that gears with the worm gear 104*a*, for linearly moving the movable blade 101 in accordance with the rotation of the gear.

In such configuration, as illustrated in FIG. 30B, the motor is driven to rotate the worm gear 104*a* to thereby cut the recording sheet P. The linear movement mechanism 104*b* converts the rotational force of the worm gear 104*a* to the force in the linear direction, and transmits the same to the movable blade 101. The movable blade 101 then moves towards the fixed blade 100, thereby making it possible to cut the recording sheet while holding it between the fixed blade 100 and the movable blade 101. The movable blade 101 returns to the original position (home position) by further rotating the motor after cutting the recording sheet P.

Using the worm gear 104*a* to slidably move the movable blade 101 is known as described in Patent Document JP 2006-075935 A.

If the bite of the fixed blade 100 and the movable blade 101 occurs during use, the worm gear 104*a* cannot rotate even if the motor is driven because the biting force is stronger. Thus, the worm gear 104*a* is forcibly rotated by hand to return the movable blade 101 to the home position. That is, the bite is resolved by forcibly slidably moving the movable blade 101 against the biting force.

A printer capable of resolving the bite between the fixed blade and the movable blade without requiring a special manual task is also known (see Patent Document JP 2004-237555 A).

This printer is briefly described with reference to the drawings.

As illustrated in FIG. 31A, the printer is mainly configured by a main unit 110 arranged in a casing (not shown), and a platen unit 111 arranged on an open/close cover (not shown) fixed to the casing in an openable/closable manner. The main unit 110 mainly incorporates a print head 112 for printing on the recording sheet P, a fixed blade 113 arranged on the downstream side in the conveying direction of the recording sheet with respect to the print head 112, and a first gear train 114 coupled to a motor (not shown).

The platen unit 111 mainly incorporates a platen roller 115 for feeding the recording sheet P, a movable blade 116 arranged on a downstream side in the conveying direction of the recording sheet with respect to the platen roller 115, and a second gear train 117 coupled to the movable blade 116, for slidably moving the movable blade 116. The platen unit 111 is combined with the main unit 110 when the open/close cover is closed, and is separated from the main unit 110 when the open/close cover is opened.

When the platen unit 111 and the main unit 110 are combined, the first gear train 114 and the second gear train 117 gear with each other, and the recording sheet P is sandwiched between the platen roller 115 and the print head 112, as illustrated in FIG. 31B. Thus, the print head 112 can perform printing, and, while feeding the recording sheet P with the platen roller 115, the movable blade 116 can be slidably moved towards the fixed blade 113 through an intermediation of the first gear train 114 and the second gear train 117 by the driving of the motor to thereby cut the recording sheet P.

The second gear train 117 is mainly configured by a gear 117*a* to be geared with the first gear train 114, and a pinion 117*b* to be geared with the gear 117*a* and a rack mechanism (not shown) fixed to the movable blade 116.

In particular, a biasing force for returning the movable blade 116 to the original position (home position) by a movable blade returning spring (not shown) acts on the pinion 117*b*. However, the pinion 117*b* is geared with the first gear train 114 when the open/close cover is closed, and hence it cannot rotate by the biasing force of the movable blade returning spring. That is, the pinion 117*b* can rotate by the biasing force of the movable blade returning spring to return the movable blade 116 to the home position only when the open/close cover is opened and the geared state of the pinion 117*b* and the first gear train 114 is released.

If bite occurs between the fixed blade 113 and the movable blade 116 while using the printer configured as described above, the open/close cover, which is closed with respect to the casing, is opened by hand. The platen unit 111 arranged on the open/close cover then separates from the main unit 110 on the casing side, as illustrated in FIG. 31C. The movable blade 116 then moves away from the fixed blade 113. Therefore, the bite of the fixed blade 113 and the movable blade 116 can be promptly resolved without requiring a special manual task. Further, the first gear train 114 and the second gear train 117 move apart, and hence the pinion 117*b* reverse-rotates by the movable blade returning spring and the movable blade 116 automatically returns to the home position, as illustrated in FIG. 31D.

Therefore, the bite of the fixed blade 113 and the movable blade 116 can be resolved with a simple operation of simply opening the open/close cover.

However, the following problems still exist in resolving the bite of the related art.

First, the method of returning the movable blade 101 to the home position by forcibly rotating the worm gear 104*a* by hand is very troublesome. Normally, when slidably moving the movable blade 101 using the rotational force of the motor, the rotation speed of the motor cannot be transmitted as is, and thus is reduced with use of the worm gear 104*a*. Thus, the motor only slightly rotates even if the worm gear 104*a* is rotated once. That is, the worm gear 104*a* needs to be rotated by the reduction ratio multiple in order to rotate the motor once. Therefore, the worm gear 104*a* needs to be rotated continuously for dozens of rotations so as to return the movable blade 101 to the home position. This is very troublesome, and the load on the operator is large. In addition, the recovery task take time, and the printing task cannot be promptly returned.

Regarding the method of resolving the bite by opening the open/close cover, the method is very simple, but the bite cannot be resolved in a situation in which the open/close cover itself cannot be opened. That is, there is a risk that the platen unit 111 gets locked to the main unit 110 or the casing depending on the jam of the recording sheet P, and in this case, the open/close cover itself cannot be opened. Thus, the movable blade 116 and the fixed blade 113 obviously cannot be spaced apart, and the bite cannot be resolved.

SUMMARY OF THE INVENTION

The present invention has been made in view of such circumstances, and an object of the present invention is to provide a printer with a cutter capable of reliably and promptly resolving the bite of the fixed blade and the movable blade through a simple operation without being influenced by the jam of the recording sheet.

The present invention provides the following means for solving the above-mentioned problems.

According to the present invention, a printer with a cutter performs printing on a recording sheet pulled out from a paper roll, and then cuts the recording sheet, the printer with a cutter being characterized by including: a fixed blade arranged so as to face the pulled out recording sheet; a movable blade slidably arranged with respect to the fixed blade and riding on an upper surface of the fixed blade when sliding, for sandwiching and cutting the pulled out recording sheet together with the fixed blade; a movable blade drive system including a rack attached to the movable blade, and a rack gear which gears with the rack, rotates in accordance with rotation of a drive gear coupled to a forward/reverse rotatable motor, and linearly moves the rack; a manipulatable lever portion; a cooperative mechanism including a pushing portion for moving the fixed blade in a direction of moving away from the movable blade in conjunction with manipulation of the lever portion, and for releasing a contacting pressure of the fixed blade and the movable blade; a first unit incorporating the fixed blade and the cooperative mechanism; and a second unit incorporating the movable blade and the movable blade drive system, and being combined with respect to the first unit, and is characterized in that one of the first unit and the second unit is separable from another unit, and the combination is released.

In the printer with a cutter according to the present invention, after printing on the recording sheet pulled out from the paper roll, the recording sheet is cut by slidably moving the movable blade by the movable blade drive system. Specifically, the motor is first driven to rotate the drive gear. The rack gear then rotates in accordance with the rotation of the drive gear, and hence the rack attached to the movable blade linearly moves. The movable blade then slidably moves. The movable blade then overlaps while riding on the upper surface of the fixed blade, thereby sandwiching and cutting the pulled out recording sheet together with the fixed blade. As a result, the cut recording sheet than can be used as a receipt, a ticket, and the like.

A case where the fixed blade and the movable blade are bitten due to the paper jam of the recording sheet during use is described. In this case, the lever portion is first manipulated. The pushing portion then moves the fixed blade in the direction of moving away from the movable blade in conjunction with the manipulation of the lever portion. That is, the fixed blade is forcibly moved to separate from the movable blade riding on the upper surface. The contacting pressure of the movable blade and the fixed blade, which is the cause of bite, then can be released. In particular, even if the contacting pressure becomes relatively high due to paper jam, the contacting pressure can be reliably released because the movement amount of the fixed blade can be adjusted with the manipulation degree of the lever portion.

Thereafter, the motor is reversely rotated when the fixed blade is being moved by the pushing portion. Here, the contacting pressure of the fixed blade and the movable blade is already released as described above, and hence the rack gear rotates and the movable blade can easily return to the original position. The bite of the fixed blade and the movable blade then can be released. Finally, the first unit and the second unit are separated to release the combination of both units. An appropriate response such as removing the portion of paper jam of the recording sheet, which is the cause of bite, then can be performed. The recovery can be carried out by again combining both units.

In particular, the contacting pressure of the fixed blade and the movable blade is eliminated, and the bite can be released with a simple method of merely manipulating the lever portion, and thus the recovery task can be promptly carried out without imposing a burden on the worker. Further, unlike the prior art of releasing the bite by opening the open/close cover, the contacting pressure is eliminated and the bite is released by forcibly moving the fixed blade in the direction of moving away from the movable blade. Therefore, even if the separation of both units is difficult due to paper jam, the bite can be reliably released. That is, the bite of the fixed blade and the movable blade can be reliably released even if the positional relationship of the first unit and the second unit combined to each other does not change depending on the state of paper jam.

Further, according to the present invention, the printer with a cutter is characterized in that: the second unit is arranged in a casing; and the first unit is arranged at an open/close door fixed to the casing in an openable/closable manner, and is separable from the second unit.

In the printer with a cutter according to the present invention, the second unit incorporating the movable blade and the movable blade drive system is arranged in the casing. The first unit incorporating the fixed blade and the cooperative mechanism is arranged on the open/close door that is openable/closable with respect to the casing. Therefore, the first unit can be separated from the second unit, or the first unit can be combined with the second unit by open/close manipulating of the open/close door.

In particular, the movable blade is arranged on the casing side, and hence the recording sheet can be cut in a more stable state, and the cut area of the recording sheet can be finished to a beautiful state. That is, if the movable blade is arranged on the open/close door of the separating side, the cut may become unstable due to a slight backlash and the like of the open/close door. Further, if external force is applied on the open/close door in time of cutting, the instability of the cut becomes more significant. However, the movable blade is arranged on the casing side, and hence such problems do not arise, and cutting can be performed in a more stable state.

Moreover, the second unit incorporating the movable blade drive system for driving the movable blade has a more complicated structure than the first unit, but such second unit is arranged on the casing side. If the second unit is arranged on the open/close door side, the structure of the second unit needs to be taken into consideration in addition to the open/close mechanism, and thus the structure of the open/close door becomes complicated and the design becomes difficult. However, the configuration is simplified because the second unit is arranged on the casing side. The open/close door can also become lighter.

Further, according to the present invention, the printer with a cutter is characterized in that the pushing portion is arranged at both ends of the fixed blade so as to simultaneously move the both ends.

In the printer with a cutter according to the present invention, the pushing portion simultaneously moves both ends of the fixed blade when the lever portion is manipulated. Force is evenly transmitted to both ends of the fixed blade as described above, and hence the fixed blade can be moved without tilting. Therefore, the contacting pressure of the movable blade and the fixed blade, which is the cause of bite, can be more reliably released.

Further, according to the present invention, the printer with a cutter is characterized by further including a release mechanism for separating a mechanical connection of the rack and the drive gear in conjunction with the manipulation of the lever portion, and for releasing a movement regulation of the rack.

In the printer with a cutter according to the present invention, the contacting pressure of the fixed blade and the movable blade can be released by the cooperative mechanism as described above when the lever portion is manipulated, and at the same time, the mechanical connection of the rack and the drive gear is separated with the operation of the release mechanism. That is, the release mechanism obtains a free state for the rack, that is, a state not associated with the motor in conjunction with the manipulation of the lever portion. The movement regulation of the rack can be thereby released, and the rack can be moved irrespective of the motor. Further, the contacting pressure of the fixed blade and the movable blade is already in the released state by the cooperative mechanism. Thus, the movable blade can be slidably moved by hand.

The movable blade then can be returned to the original position by hand without again operating the motor, whereby the recovery task can be performed in a shorter period of time.

Further, according to the present invention, the printer with a cutter is characterized by further including a biasing member for biasing and moving the movable blade so as to return the movable blade to a predetermined position when the movement regulation of the rack is released.

In the printer with a cutter according to the present invention, when the movement regulation of the rack is released by the release mechanism so as to be able to freely move, the bias member biases the movable blade, and returns the movable blade to a predetermined position. That is, the movable blade can be automatically returned to a predetermined position. Therefore, the recovery task can be carried out in a shorter period of time.

According to the printer with a cutter of the present invention, the bite of the fixed blade and the movable blade can be reliably and promptly released with a simple manipulation without being influenced by the state of paper jam of the recording sheet. In particular, the bite of the fixed blade and the movable blade can be reliably released with the first unit and the second unit being combined with each other.

BRIEF DESCRIPTION OF THE DRAWINGS

In the accompanying drawings:

FIG. 18A illustrates a state of printing on the recording sheet, FIG. 18B illustrates a state of cutting the recording sheet, FIG. 18C illustrates a state of releasing the bite of the fixed blade and the movable blade, and FIG. 18D illustrates a state in which the open/close door is opened;

FIG. 22A is a side view of the main unit illustrated in FIG. 20 seen from the opposite side, and FIG. 22B is a perspective view of the coil spring incorporated in the pinion illustrated in FIG. 22A;

DETAILED DESCRIPTION OF THE PREFERRED EMBODIMENT

First Embodiment

A first embodiment of the printer with a cutter according to the present invention is described with reference to FIGS. 1 to 19. In this embodiment, a thermal printer is exemplified as one example of a printer with a cutter.

Figure 1:
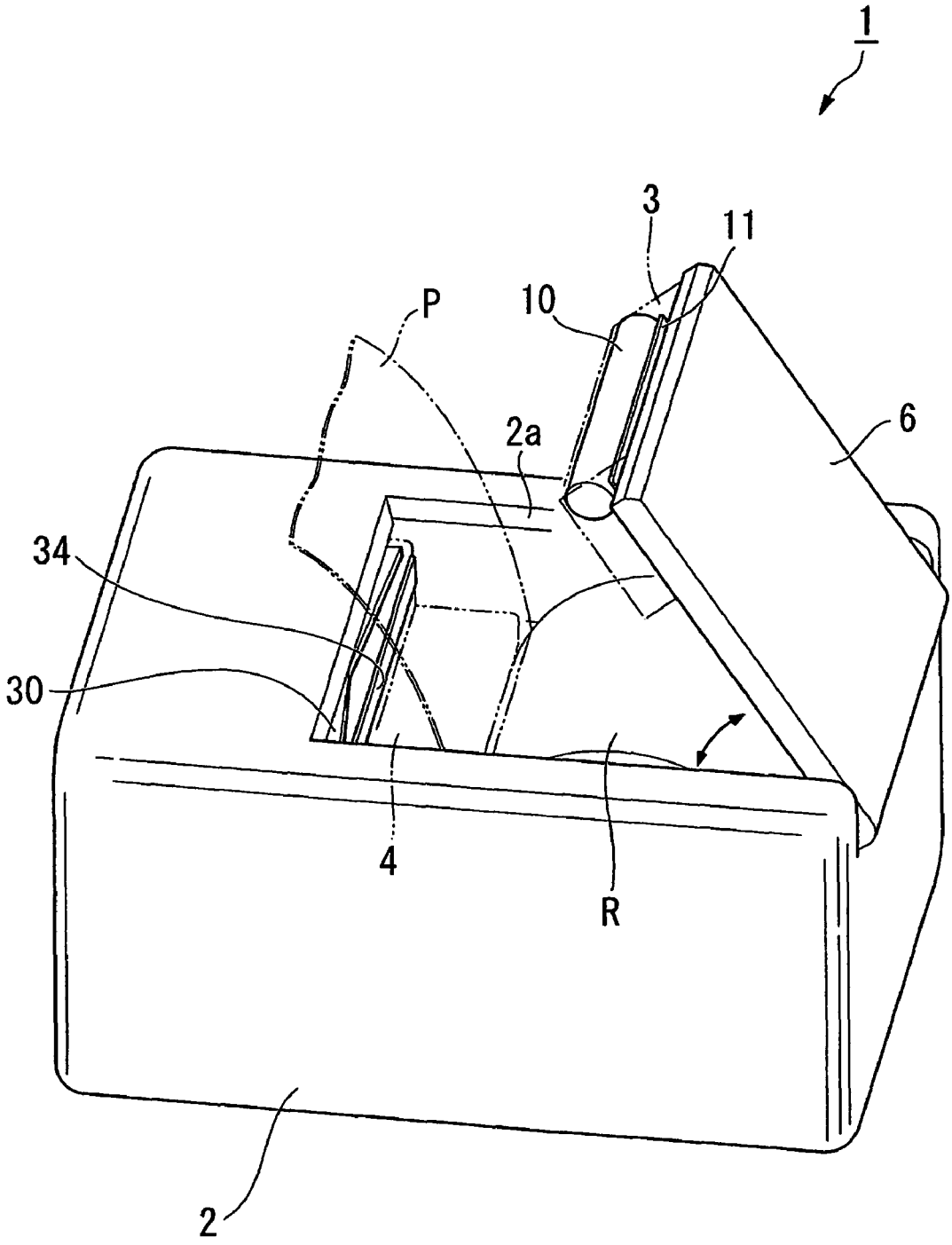
FIG. 1 is a perspective view of an outer appearance of a printer with a cutter according to a first embodiment of the present invention, illustrating a state in which an open/close door is opened.
Figure 2:
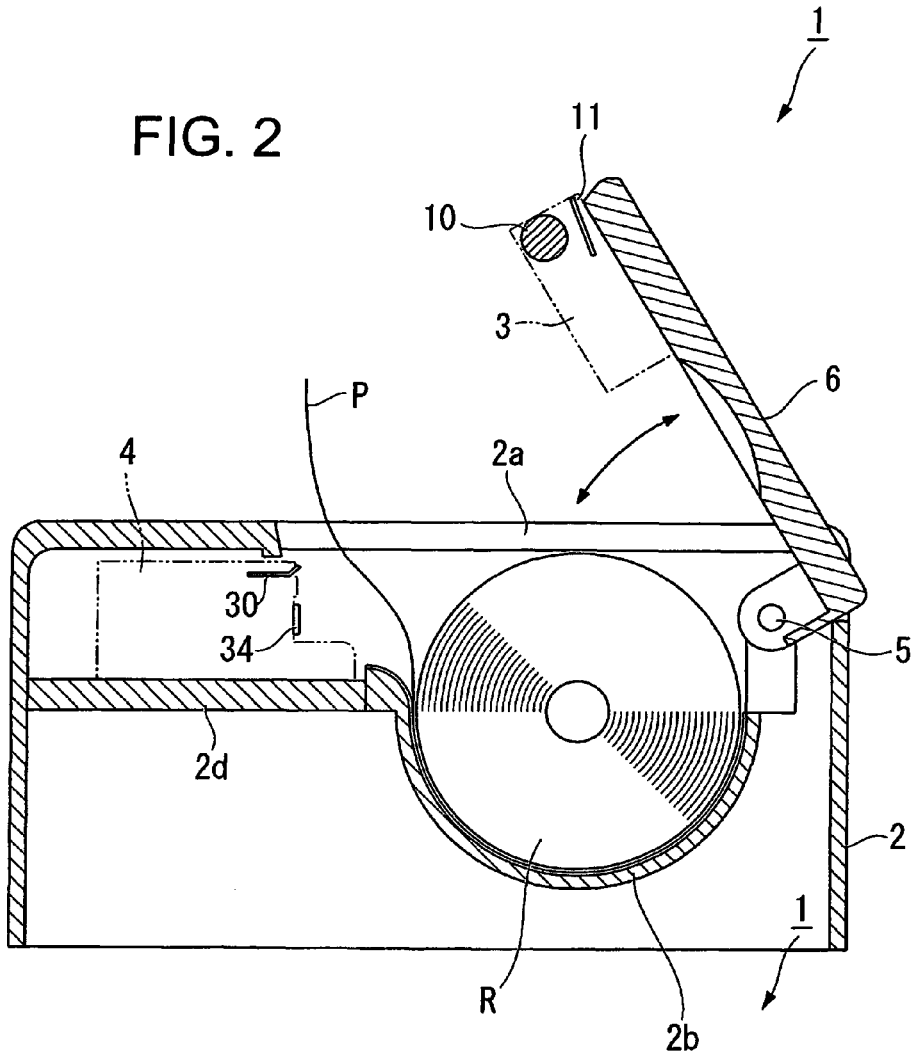
FIG. 2 is a cross-sectional view of the printer with a cutter illustrated in FIG. 1.

A thermal printer 1 of this embodiment is a printer that can appropriately cut a recording sheet P after printing on the recording sheet P pulled out from a paper roll R to use as a ticket, a receipt, and the like, and mainly includes a casing 2, a platen unit (first unit) 3, and a main unit (second unit) 4, as illustrated in FIG. 1 and FIG. 2.

The casing 2 is a casing molded from a plastic or a metal material, and is formed to a box-shape with an insertion port 2*a* opened at the upper surface. A mounting board 2*b* for mounting the paper roll R inserted from the insertion port 2*a* is arranged in the interior of the casing 2. The mounting board 2*b* is formed to curve to an arcuate shape, and enables the cylindrical paper roll R to be stably mounted.

An open/close door 6 fixed in an openable/closable manner through an intermediation of a hinge portion 5 is attached to the upper surface of the casing 2. The open/close door 6 opens and closes within a range of a constant angle from an opened state illustrated in FIG. 2 to a closed state illustrated in FIG. 3. The insertion port 2*a* appears when the open/close door 6 is opened, and hence the paper roll R can be inserted into or be taken out from the casing 2. A slight gap is designed to be formed between the distal end of the open/close door 6 and the casing 2 when the open/close door 6 is closed. The recording sheet P is pulled out from the interior of the casing 2 utilizing such gap. In other words, the gap functions as a discharge port 2*c* for the recording sheet P.

Note that the open/close door 6 automatically locks with respect to the casing 2 by a lock mechanism (not shown) when closed. The lock mechanism unlocks with one-touch from the outer side of the casing 2, and hence the open/close door 6 can be promptly opened.

Figure 3:
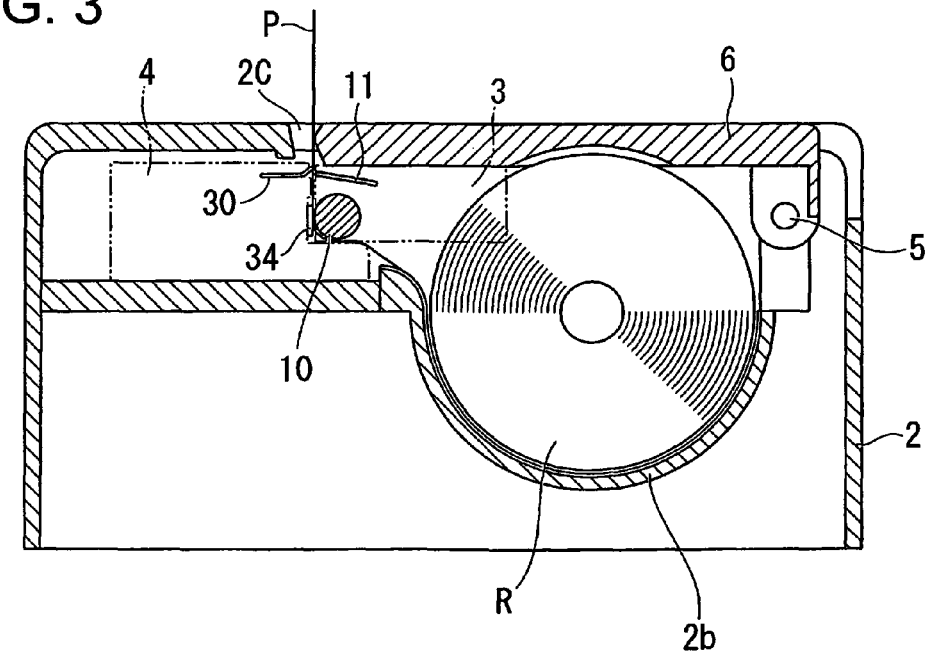
FIG. 3 is a view illustrating a state when the open/close door is closed from the state illustrated in FIG. 2.

The main unit 4 is a unit mainly incorporating a movable blade 30, a movable blade drive system 31, a lever portion 32, and a thermal head 34, as hereinafter described, and is arranged in the casing 2, as illustrated in FIG. 1 to FIG. 3. Specifically, it is fixed on an inner plate 2*d* integrally formed with the mounting board 2*b* on which the paper roll R is mounted. In FIG. 1 to FIG. 3, the movable blade 30 and the thermal head 34 are representatively illustrated.

The platen unit 3 is a unit mainly incorporating a fixed blade 11, a cooperative mechanism 13, and a platen roller 10, to be hereinafter described, and is arranged on the inner surface of the distal end side of the open/close door 6 through an intermediation of an attachment plate 15. Thus, the platen unit 3 can move, combine with the main unit 4, or separate from the main unit 4 with the open/close operation of the open/close door 6.

The configuration of the platen unit 3 is first described in detail.

Figure 4:
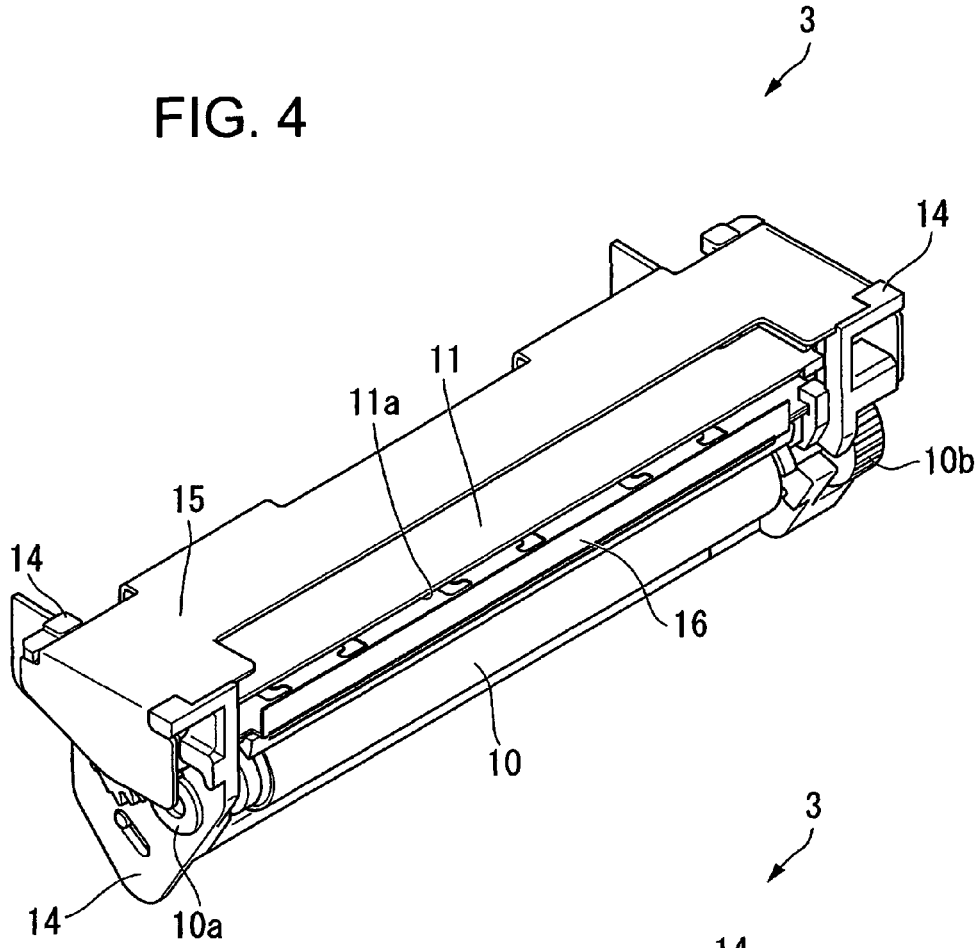
FIG. 4 is a perspective view of a platen unit configuring the printer with a cutter.
Figure 5:
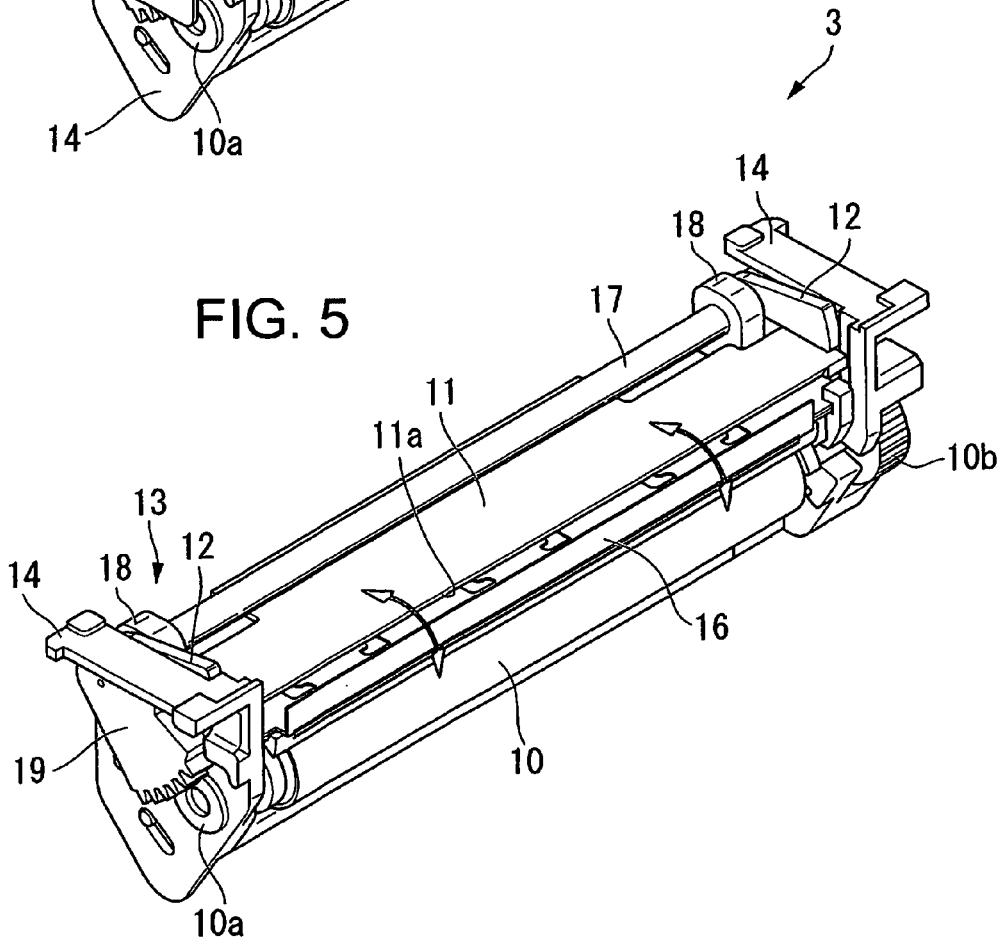
FIG. 5 is a view illustrating a state in which an attachment plate is detached from the state illustrated in FIG. 4.

As illustrated in FIG. 4 and FIG. 5. the platen unit 3 includes a platen roller 10 made of an elastic body such as rubber, for feeding the recording sheet P; the fixed plate 11 arranged on the downstream side of the conveying direction of the recording sheet P with respect to the platen roller 10; the cooperative mechanism 13 with a pushing portion 12 for moving the fixed blade 11 in a direction of moving away from the movable blade 30 and canceling the contacting pressure of the fixed blade 11 and the movable blade 30; a metal platen frame 14 for rotatably supporting the platen roller 10; and a metal attachment plate 15 which covers the upper side of the platen frame 14. FIG. 5 is a view illustrating a state in which the attachment plate 15 is detached from FIG. 4.

The platen roller 10 has a shaft body (not shown) extending from both ends, which are respectively covered with a cylindrical bearing 10*a*. The platen roller 10 then can rotate even if the two bearings 10*a* are held down. The platen roller 10 is supported by the platen frame 14 through an intermediation of the bearing 10*a*. In this case, a driven gear 10*b* is fixed to one end side of the platen roller 10 with the bearing 10*a* sandwiching therebetween while being coupled to the shaft body.

In particular, as illustrated in FIG. 3, the platen roller 10 is arranged such that the outer peripheral surface is brought into contact with the thermal head 34 on the main unit 4 side with the recording sheet P sandwiching therebetween when the open/close door 6 is closed and the platen unit 3 and the main unit 4 are combined. In this case, the driven gear 10*b* gears with a platen gear train 60, to be hereinafter described, on the main unit 4 side so that the rotational force is transmitted. The platen roller 10 then rotates by the rotational force transmitted from the main unit 4 side after the open/close door 6 is closed, and feeds the recording sheet P pulled out from the paper roll R to the outside of the casing 2 from the discharge port 2*c*.

Returning to FIG. 4 and FIG. 5, the fixed blade 11 is a plate-shaped blade extending in the width direction of the recording sheet P, and is supported by a fixed blade holder 16 such that a cutting edge 11*a* faces the fed recording sheet P when the open/close door 6 is closed. The fixed blade 11 is supported in a swingable manner so that the cutting edge 11*a* side moves up and down (direction substantially orthogonal to the sliding direction of the movable blade 30). An elastic member (not shown) for biasing the fixed blade 11 upward is arranged between the fixed blade holder 16 and the fixed blade 11. The cutting edge 11*a* of the fixed blade 11 is thus constantly biased so as to be lifted up. The lifting amount of the fixed blade 11 is regulated by the attachment plate 15.

As illustrated in FIG. 5, a rotatable shaft 17 is arranged between the fixed blade 11 and the attachment plate 15 with the root side of the fixed blade 11 arranged along the fixed blade 11. The shaft 17 is rotatably supported by a bearing member 18 fixed to the platen frame 14. The pushing portion 12 and a sector gear 19 are coupled to one end side of the shaft 17, and only the pushing portion 12 is coupled to the other end side.

The sector gear 19 gears to an internal gear 32*a* of the lever portion 32 that can be push-down manipulated, to be hereinafter described, arranged on the main unit 4 side when the open/close door 6 is closed. Thus, the sector gear 19 rotates in conjunction with the manipulation of the lever portion 32, that is, in conjunction with the push-down operation. When the sector gear 19 rotates, the shaft 17 similarly rotates.

Note that, the phrase "in conjunction with the manipulation of the lever 32" is appropriately described below as a meaning of "in conjunction with the push-down operation of the lever portion 32".

The pushing portion 12 is coupled to the shaft 17 so as to be positioned on the inner side of the platen frame 14 and at both ends of the fixed blade 11. The pushing portion 12 rotates with the shaft 17 with the rotation of the sector gear 19, and acts to push down the cutting edge 11*a* side of the fixed blade 11 downward. The fixed blade 11 then moves to move away from the movable blade 30, and the contacting pressure of the blades 11, 30 is canceled.

In other words, the two pushing portions 12, the sector gear 19, and the shaft 17 function as the cooperative mechanism 13 for moving the fixed blade 11 in the direction of moving away from the movable blade 30 in conjunction with the manipulation of the lever portion 32, and canceling the contacting pressure of the blades 11, 30.

Next, the main unit 4 is described in detail below.

Figure 6:
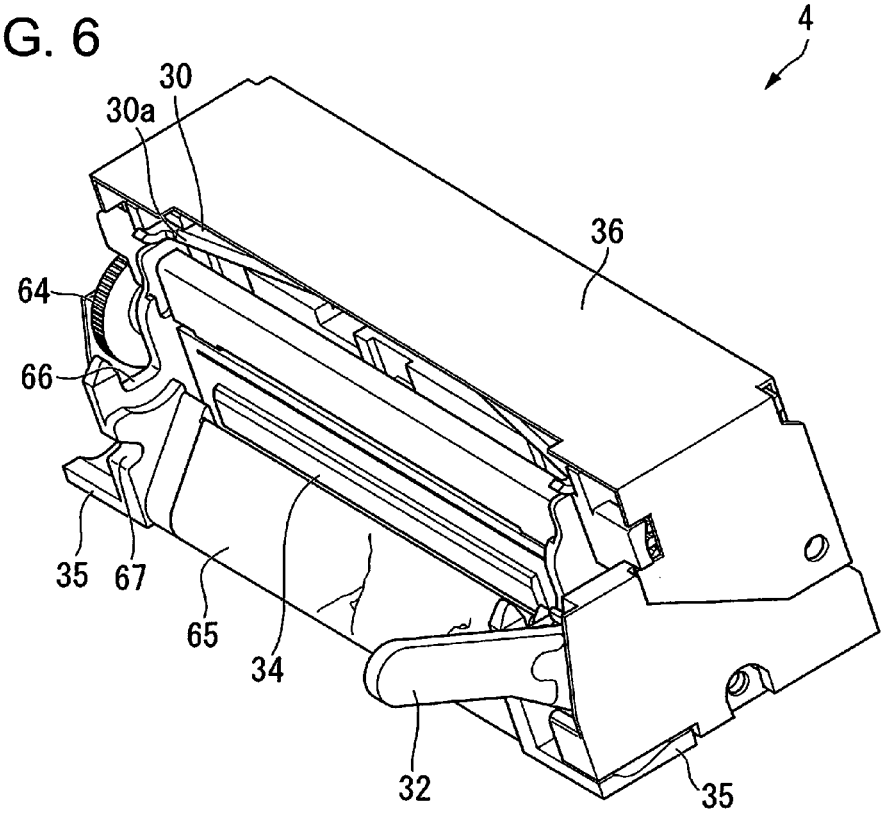
FIG. 6 is a perspective view of a main unit configuring the printer with a cutter.
Figure 7:
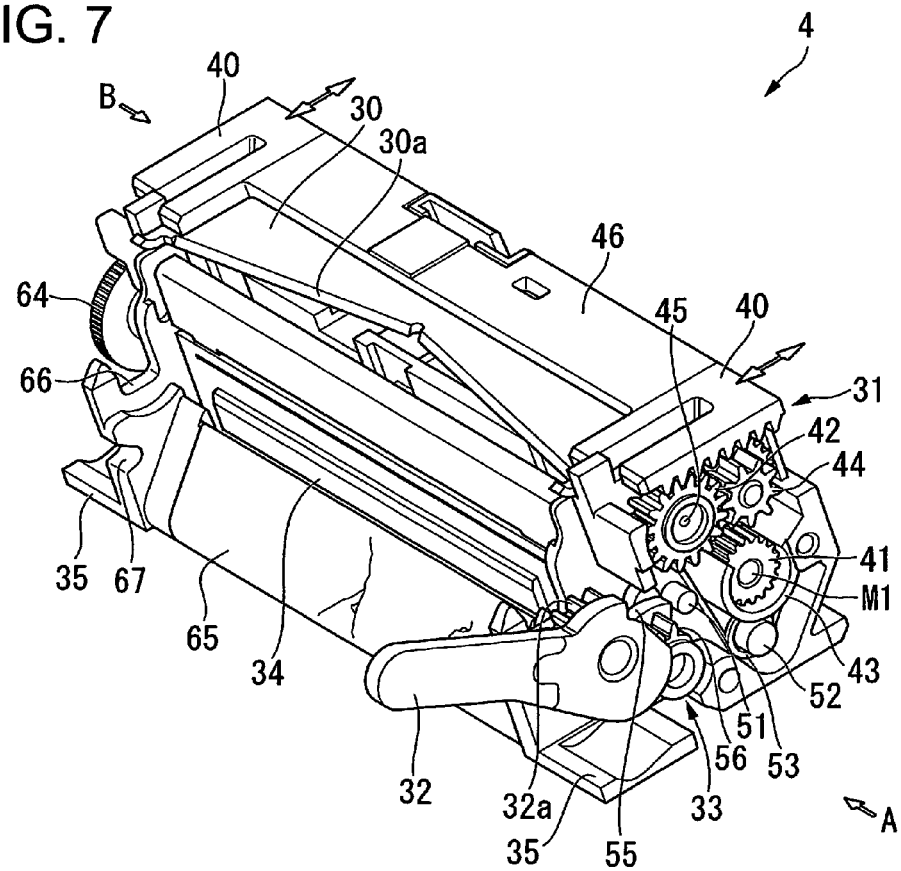
FIG. 7 is a view illustrating a state in which a cover plate is detached from the state illustrated in FIG. 6.

As illustrated in FIG. 6 and FIG. 7, the main unit 4 includes the movable blade 30 slidably movable with respect to the fixed blade 11, the movable blade drive system 31 for driving the movable blade 30, the lever portion 32 that can be push-down manipulated, a cancel mechanism 33 for separating the mechanical connection of a drive gear 41 and a rack 40, to be hereinafter described, in conjunction with the push-down operation of the lever portion 32, the thermal head 34 for performing recordation on the pulled out recording sheet P, a metal support frame 35, fixed on the internal plate 2*d*, for supporting each component, and a metal cover plate 36 for covering the upper side of the movable blade 30. FIG. 7 is a view illustrating a state in which the cover plate 36 is detached from FIG. 6.

Figure 8:
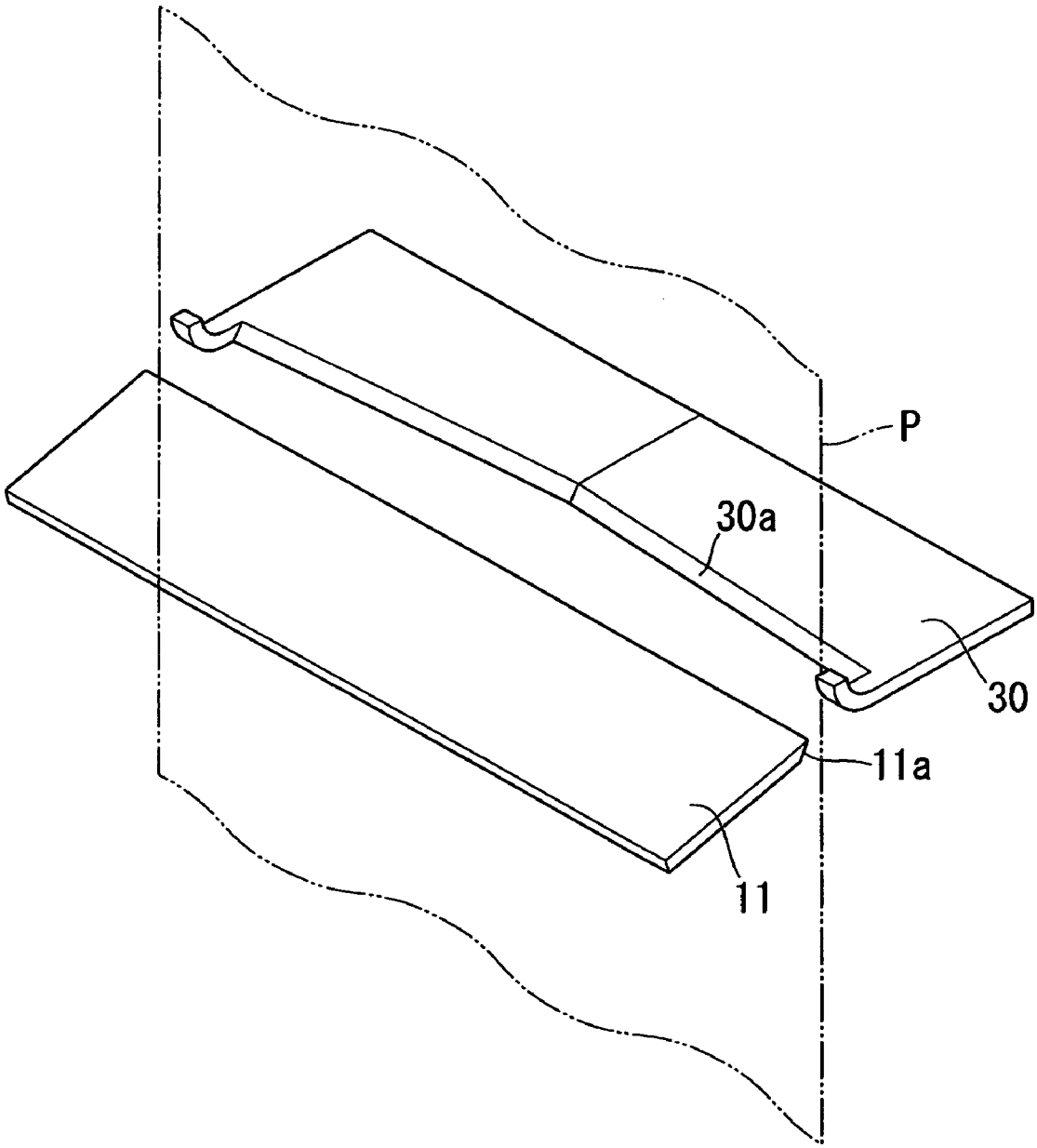
FIG. 8 is a view illustrating a positional relationship between a fixed blade and a movable blade during printing.
Figure 9:
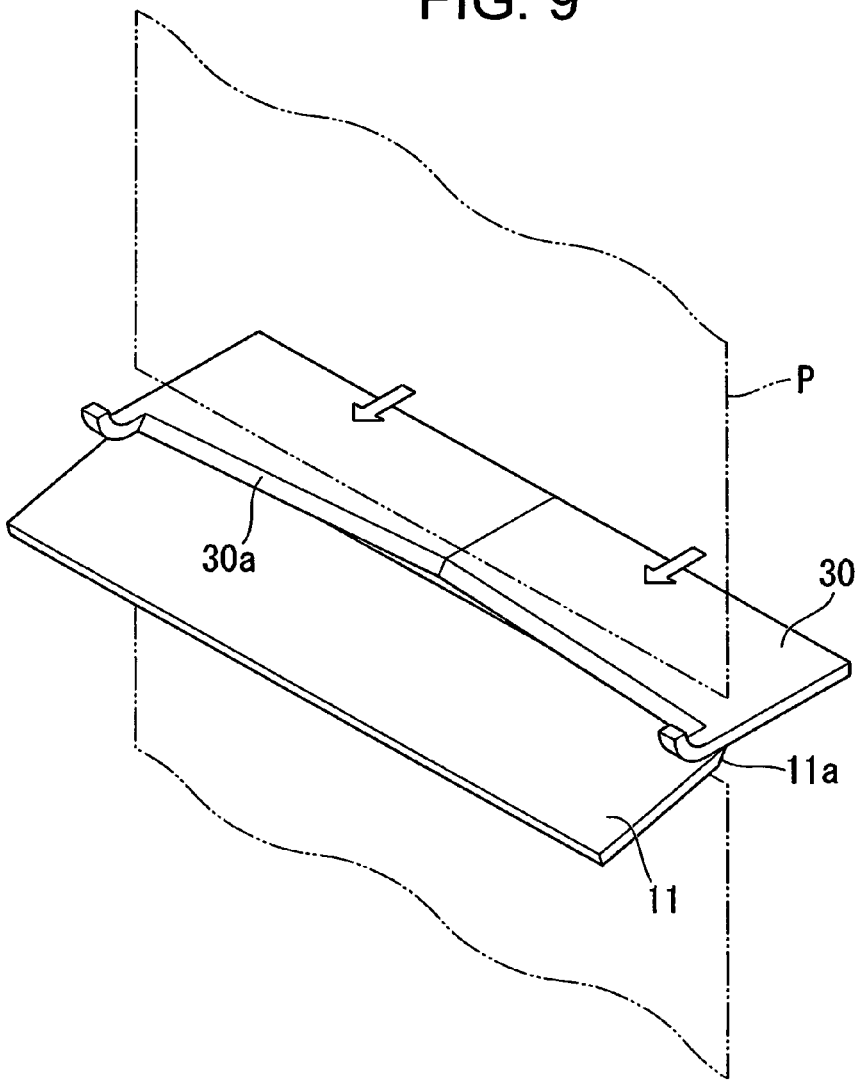
FIG. 9 is a view illustrating a state of sliding the movable blade from the state illustrated in FIG. 8, and cutting a recording sheet between the fixed blade and the movable blade.
Figure 10:
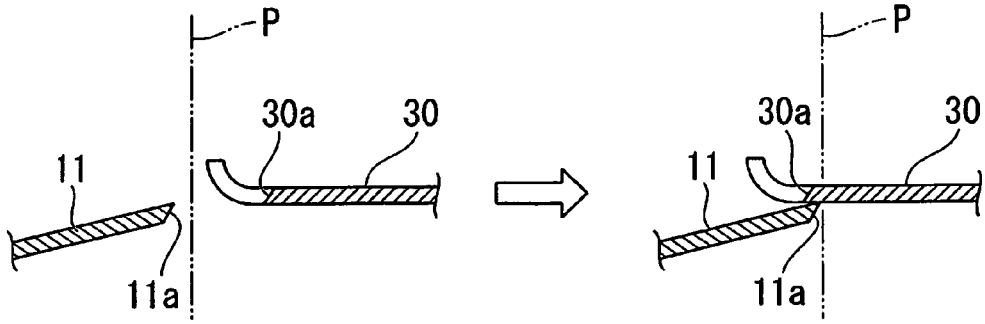
FIG. 10 is a cross-sectional view illustrating movement of the fixed blade and the movable blade while shifting from the state illustrated in FIG. 8 to the state illustrated in FIG. 9.

The movable blade 30 functions as a cutter in cooperation with the fixed blade 11, and is arranged at a position facing the fixed blade 11 when the open/close door 6 is closed and the main unit 4 and the platen unit 3 are combined. As illustrated in FIG. 8, the movable blade 30 is a plate-shaped blade having a substantially V-shape in top view formed such that the length from the root to the cutting edge 30*a* gradually becomes shorter from both ends towards the middle. As illustrated in FIG. 9 and FIG. 10, when slid towards the fixed blade 11, the movable blade 30 rides on the upper surface of the fixed blade 11 to thereby sandwich and cut the recording sheet P with the fixed blade 11.

When the movable blade 30 is slid, the fixed blade 11 is pushed down towards the platen roller 10 by the movable blade 30. However, the fixed blade 11 is biased to the upper side by the elastic member, and hence the blades 11, 30 are held in contact with each other at an appropriate contacting pressure, as illustrated in FIG. 10.

Returning back to FIG. 6 and FIG. 7, the movable blade drive system 31 includes the rack 40 attached to the movable blade 30, and a first gear (rack gear) 42 and a third gear (rack gear) 43 (not shown in FIG. 6 and FIG. 7) which gear with the rack 40, rotate with the rotation of the drive gear 41 coupled to the forward/reverse rotatable motor, and linearly move the rack 40. In this embodiment, the motor and the drive gear 41 are provided in the main unit 4.

Figure 11:
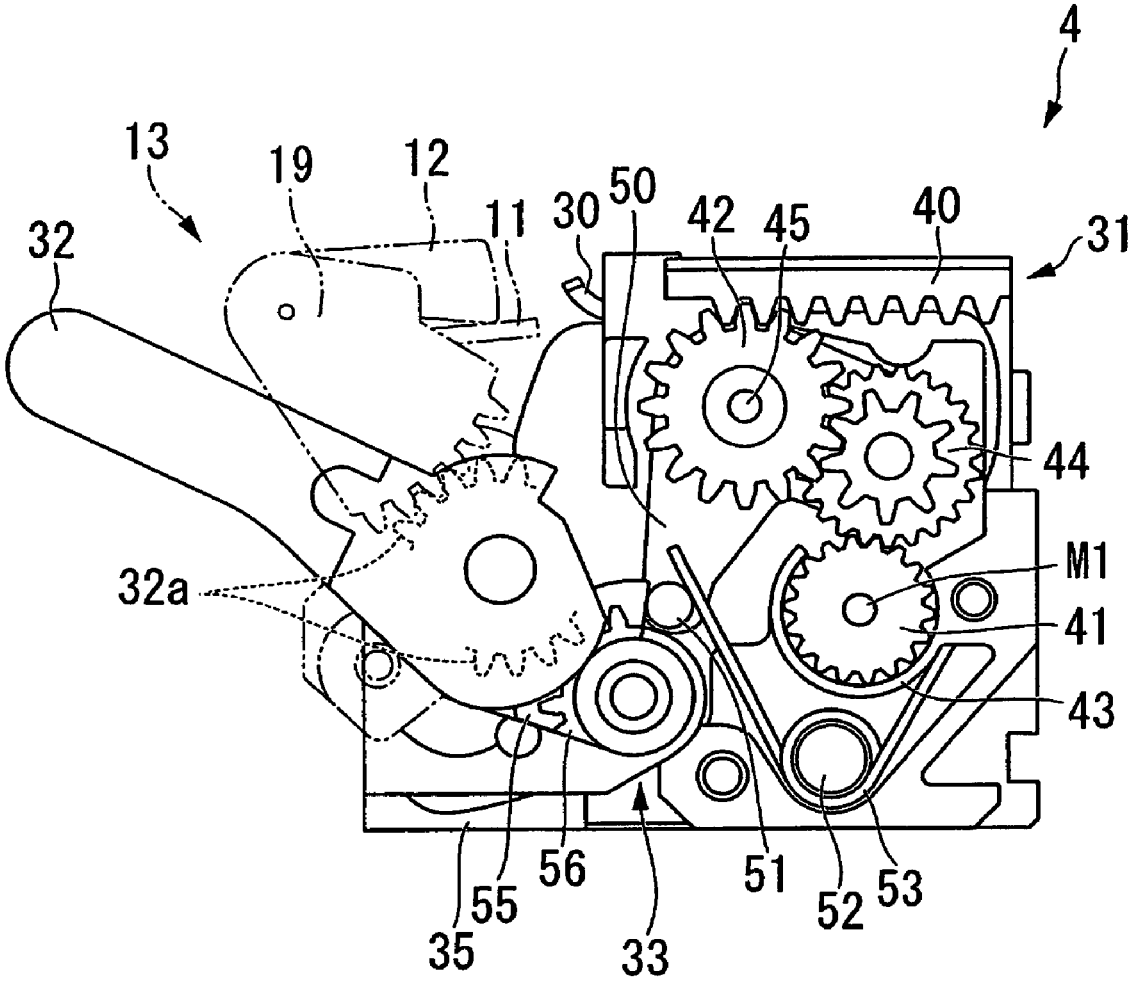
FIG. 11 is a side view of the main unit of FIG. 7 seen from a direction of an arrow A.

As illustrated in FIG. 7 and FIG. 11, the drive gear 41 is coupled to a drive shaft M1 of the motor and is arranged on one side surface of the main unit 4. In this case, the drive gear 41 has a part of the peripheral surface protected by an arcuate protective cover 43. The first gear 42 is arranged on the upper side of the drive gear 41 while being geared with the rack 40. A second gear 44, which gears with the gears 41, 42, is arranged between the first gear 42 and the drive gear 41.

Thus, when the drive gear 41 rotates by the drive of the motor, the rotational force is transmitted to the first gear 42 via the second gear 44 so that the rack 40 linearly moves. That is, the first gear 42 rotates with the rotation of the drive gear 41, and linearly moves the rack 40.

Figure 12A:
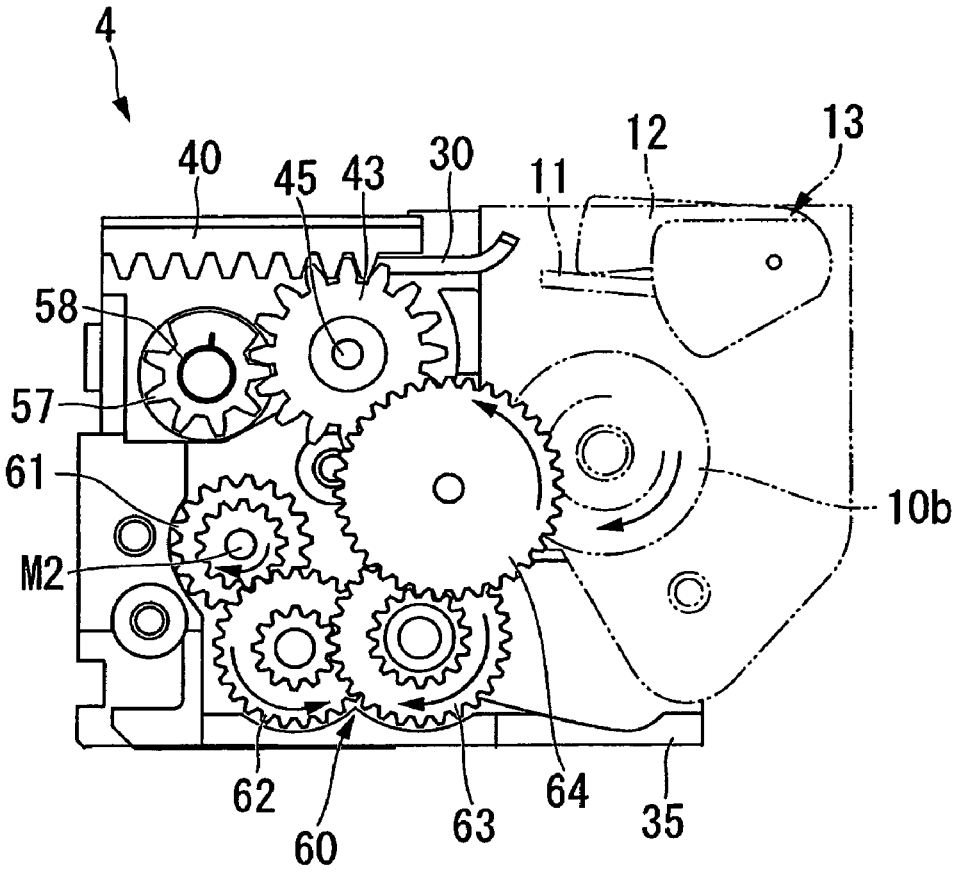
FIG. 12A is a side view of the main unit of FIG. 7 seen from a direction of an arrow B.

The first gear 42 is coupled to a shaft 45 extending to the other side surface of the main unit 4. As illustrated in FIG. 12A, the third gear 43 geared with the rack 40 is coupled to the shaft 45 at the other side surface of the main unit 4. Thus, the third gear 43 also rotates with the rotation of the first gear 42, and the rack 40 also linearly moves.

The rack 40 geared with the first gear 42 and the third gear 43 is attached to both ends of a flat support plate 46 fixed to the root side of the movable blade 30, as illustrated in FIG. 7. Thus, when the first gear 42 and the third gear 43 rotate, the two racks 40 simultaneously move in the same direction, and consequently slidably moves the movable blade 30.

Figure 13:
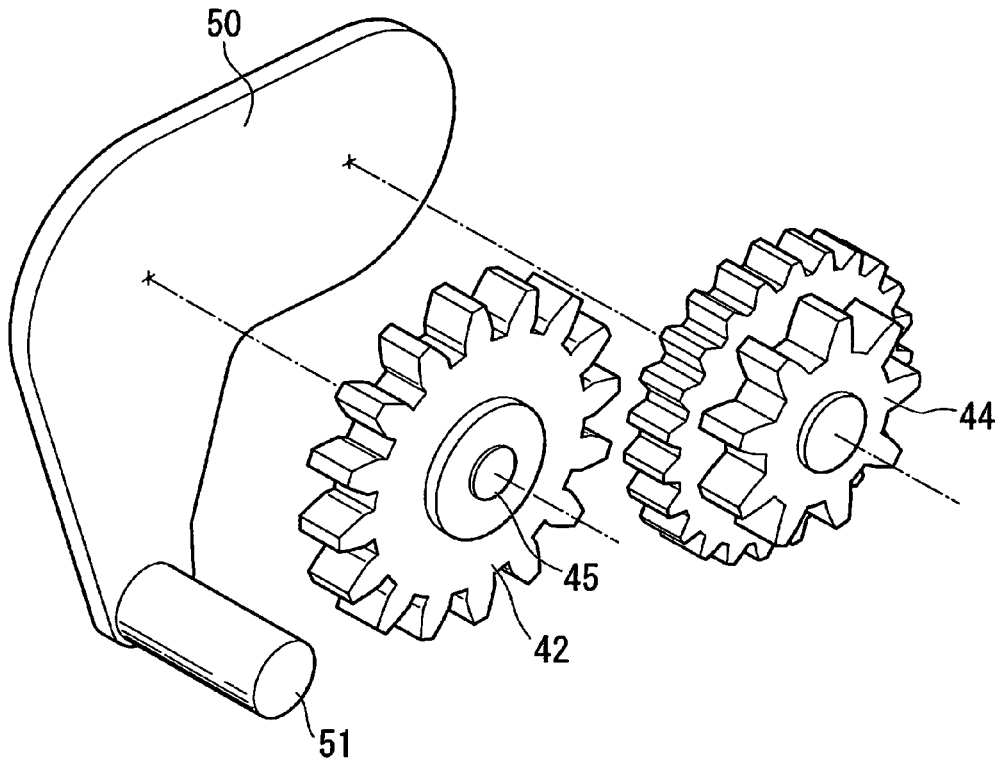
FIG. 13 is an enlarged perspective view illustrating an attachment state of a swinging plate, a first gear, and a second gear illustrated in FIG. 11.
Figure 14:
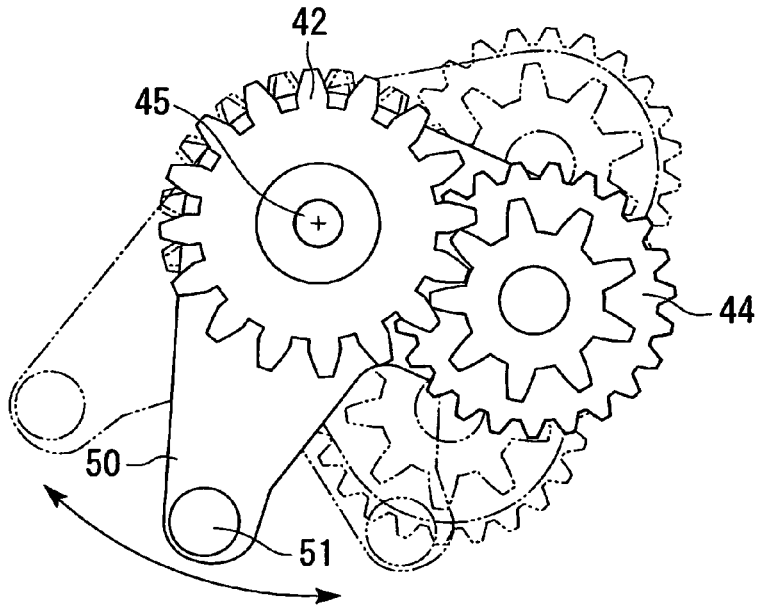
FIG. 14 is a view of the swinging plate illustrated in FIG. 13 seen from the front.

As illustrated in FIG. 11, a swinging plate 50 formed to a substantially C-shape in plane view is arranged on the inner side of the first gear 42. As illustrated in FIG. 13 and FIG. 14, the swinging plate 50 swings to the left or the right with the shaft 45 coupled to the first gear 42 as the center. The second gear 44 is rotatably supported by the swinging plate 50. Thus, if the swinging plate 50 swings, the second gear 44 swings with the shaft 45 as the center.

A pin 51 projecting to the outer side of the main unit 4 is attached to the end of the swinging plate 50. As illustrated in FIG. 11, the second gear 44 moves in the direction of moving away from the drive gear 41 when the swinging plate 50 is moved to move the pin 51 closer to the drive gear 41, whereas the second gear 44 moves in the direction of moving closer to the drive gear 41 when the swinging plate 50 is moved to move the pin 51 away from the drive gear 41.

As illustrated in FIG. 7 and FIG. 11, a fixed pin 52 is formed on the lower side of the drive gear 41 in adjacent to the protective cover 43. A torsion spring 53 is fixed to the fixed pin 52. One end side of the torsion spring 53 is fixed to the support frame 35, and the other end side is constantly biased in the direction of moving the pin 51 of the swinging plate 50 away from the drive gear 41. As described above, the second gear 44 and the drive gear 41 are constantly geared with each other in normal time.

The lever portion 32 is arranged adjacent to the swinging plate 50. The lever portion 32 is rotatably supported on the inner side of the cover plate 36, and hence it can be pushed downward. The lever portion 32 can be manipulated from the outer side of the casing 2 through an intermediation of a coupling mechanism (not shown).

An internal gear 32*a* is formed on the inner side of the lever portion 32, and hence a part of the internal gear 32*a* gears with the sector gear 19 on the platen unit 3 side when the open/close door 6 is closed and the main unit 4 and the platen unit 3 are combined. Thus, the cooperative mechanism 13 operates in conjunction with the push-down operation of the lever portion 32, as described above.

A release plate 55 formed to a fan-shape is arranged between the lever portion 32 and the swinging plate 50, and is rotatably supported by the support frame 35. A release gear 56 is attached to the release plate 55, and is geared with a part of the internal gear 32*a* of the lever portion 32. Thus, when the lever portion 32 is pushed down, the release plate 55 rotates towards the drive gear 41.

The pin 51 of the swinging plate 50 biased by the torsion spring 53 is held in contact with the side surface of the release plate 55. Thus, when the release plate 55 rotates towards the drive gear 41, the pin 51 is pushed towards the drive gear 41 against the biasing force of the torsion spring 53, thereby moving the swinging plate 50. As a result, the second gear 44 moves away from the drive gear 41, thereby releasing the geared state thereof. The second gear 44, the first gear 42, and the rack 40 then enter a free state.

That is, the mechanical connection between the rack 40 and the drive gear 41 is separated, and the movement regulation of the rack 40 is released to a free state. In other words, the swinging plate 50, the pin 51, the torsion spring 53, and the release plate 55 described above function as a release mechanism 33.

Figure 12B:
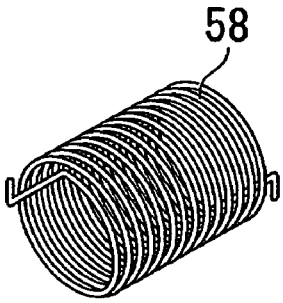
FIG. 12B is a perspective view of a coil spring incorporated in a pinion illustrated in FIG. 12A.

As illustrated in FIG. 12A, a pinion 57 gearing with the third gear 43 is rotatably supported by the support frame 35 at the other side surface of the main unit 4. As illustrated in FIG. 12B, a coil spring 58 is incorporated in the pinion 57. The coil spring 58 is compressed when the third gear 43 rotates and slidably moves the movable blade 30 towards the fixed blade 11, and rotatably biases the pinion 57 so as to reverse rotate the third gear 43. However, the third gear 43 is engaged with the drive gear 41 in normal time, and hence it cannot reverse rotate with the force of the coil spring 58.

However, when the movement regulation of the rack 40 is released by the release mechanism 33 so as to enter a free state, the third gear 43 reverse rotates by the force of the coil spring 58. As a result, the movable blade 30 can be automatically returned to the original position.

That is, the coil spring 58 functions as a biasing member for biasing the movable blade 30 to return to a predetermined position, and automatically moving the movable blade 30 to a predetermined position when the movement regulation of the rack 40 is released.

Further, a platen gear train 60 geared with the driven gear 10*b* on the platen unit 3 side when the main unit 4 and the platen unit 3 are combined, and a platen drive gear 61 coupled to a drive shaft M2 of the platen motor (not shown) and geared with the platen gear train 61 are arranged on the lower side of the pinion 57.

The platen gear train 60 includes a fourth gear 62 gearing with the platen drive gear 61, a fifth gear 63 gearing with the fourth gear 62, and a sixth gear 64 gearing with the fifth gear 63 and the driven gear 10*b*.

As illustrated in FIG. 6 and FIG. 7, the thermal head 34 is formed to extend in the width direction of the recording sheet P, and is arranged at a position facing the platen roller 10 when the open/close door 6 is closed. The thermal head 34 includes a great number of heat generating elements (not shown), and is biased towards the platen roller 10 by a coil spring (not shown) and the like. Thus, the thermal head 34 can be reliably pressed against the recording sheet P fed by the platen roller 10, thereby enabling satisfactory printing.

The lower side of the thermal head 34 is provided with a guide board 65 formed to curve so that the recording sheet P can be smoothly pulled in. A fit-in hole 66 to be fitted with a bearing 10*a* arranged at the shaft part of the platen roller 10 is formed on the upper side of the guide board 65. That is, when the open/close door 6 is closed, the baring 10*a* of the platen roller 10 naturally fits into the fit-in hole 66. The main unit 4 and the platen unit 3 are thereby combined.

Note that, the plate unit 3 is attached with a lock shaft (not shown) that fits into a lock groove 67 formed on the lower side of the fit-in hole 66. The lock shaft is a shaft arranged parallel to the platen roller 10 in the vicinity of the platen roller 10, and is automatically locked within the lock groove 67 when the units are combined. As a result, the units 3, 4 cannot separate unless the lock is unlocked. The unlocking of the lock is carried out in conjunction with the lock mechanism for unlocking the lock of the open/close door 6.

Next, the operation of the thermal printer 1 configured as above is described.

First, as illustrated in FIG. 1 and FIG. 2, the paper roll R is placed in the casing 2 from the insertion port 2*a* with the open/close door 6 being opened. In this case, the recording sheet P is pulled out by a length of a certain extent to the outer side of the casing 2 in advance. The open/close door 6 is closed and the open/close door 6 is locked by the lock mechanism with the pulled out recording sheet P being pulled out to the outer side of the casing 2. When the open/close door 6 is closed, the bearing 10*a* of the platen roller 10 is fitted into and fitted with the fit-in hole 66 on the main unit 4 side, and the lock shaft fits into and automatically locked with the lock groove 67 on the main unit 4 side. The main unit 4 and the platen unit 3 are thereby combined to each other.

As illustrated in FIG. 3, the recording sheet P is sandwiched between the platen roller 10 and the thermal head 34, and is pulled out to the outer side of the casing 2 from the discharge port 2*c*.

After setting the paper roll R as described above, various information are printed on the recording sheet P.

First, as illustrated in FIG. 12A and FIG. 12B, the platen motor is driven to rotate the platen drive gear 61. Then, the rotational force is transmitted to the driven gear 10*b* through the platen gear train 60, thereby rotating the platen roller 10. The recording sheet P sandwiched between the outer peripheral surface of the platen roller 10 and the thermal head 34 is thereby fed to the upper side of the casing 2, and the paper roll R mounted on the mounting board 2*b* rotates.

The thermal head 34 is operated at the same time. A great number of heat generating elements then appropriately emit heat. Various characters, figures, and the like then can be clearly printed on the fed recording sheet P. Thereafter, the recording sheet P further fed by the platen roller 10 passes between the fixed blade 11 and the movable blade 30.

Figure 15:
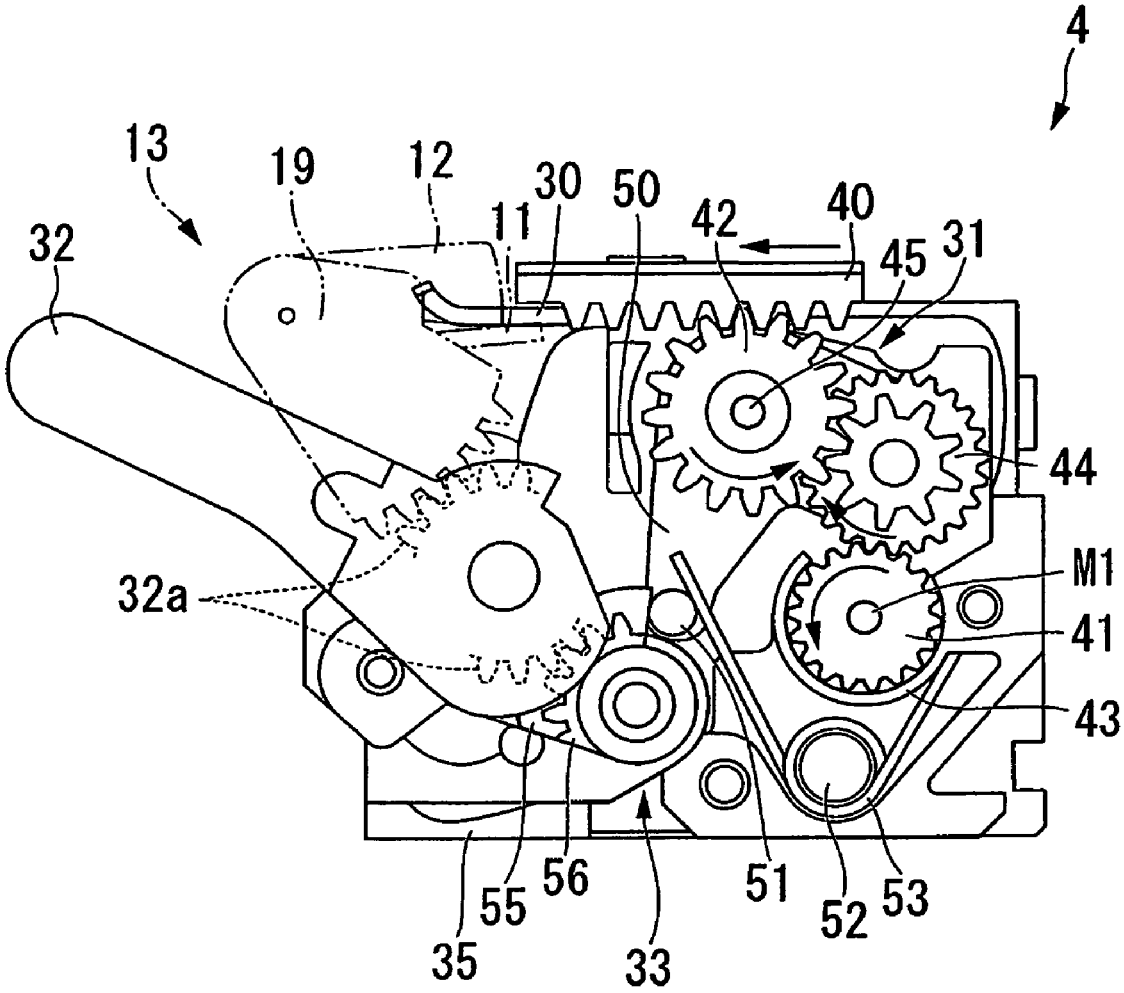
FIG. 15 is a view illustrating a state of slidably moving the movable blade from the state illustrated in FIG. 11.

Next, when the printing is terminated and the recording sheet P is to be cut, the motor is driven to rotate the drive gear 41. As illustrated in FIG. 15, the rotational force is transmitted to the first gear 42 through the second gear 44, thereby rotating the first gear 42. At the same time, the third gear 43 coupled to the first gear 42 through an intermediation of the shaft 45 rotates. The rack 40 geared with the first gear 42 and the third gear 43 then linearly moves. The movable blade 30 slidably moves towards the fixed blade 11 so as to shift from the state illustrated in FIG. 16 and FIG. 18A to the state illustrated in FIG. 17 and FIG. 18B through the support plate 46 to which the rack 40 is fixed.

Figure 16:
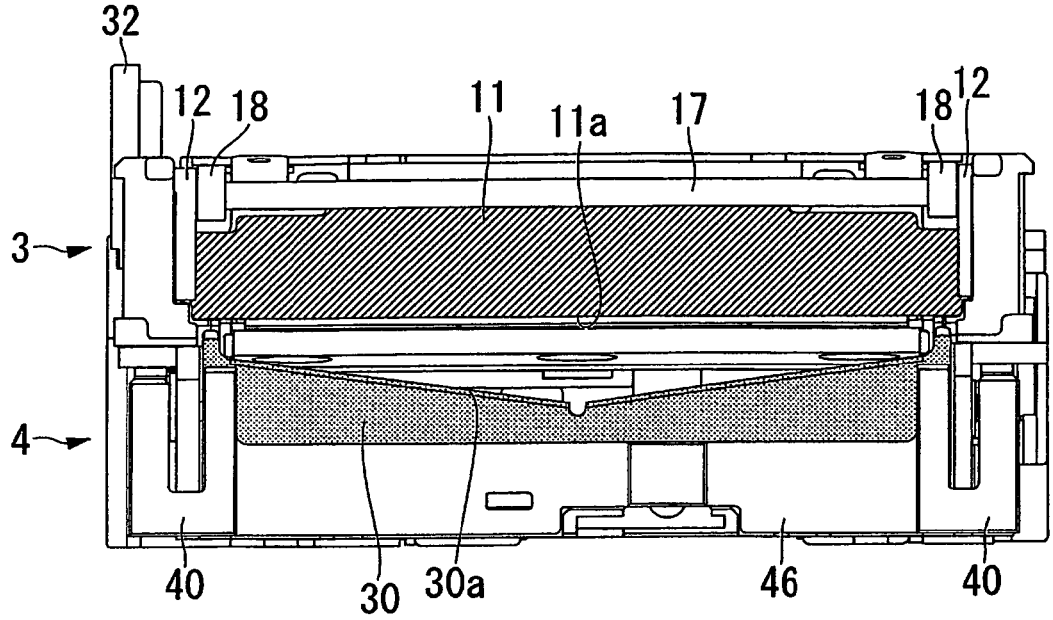
FIG. 16 is a view seen from the upper side of the state in which the platen unit of FIG. 5 and the main unit illustrated in FIG. 7 are combined.
Figure 17:
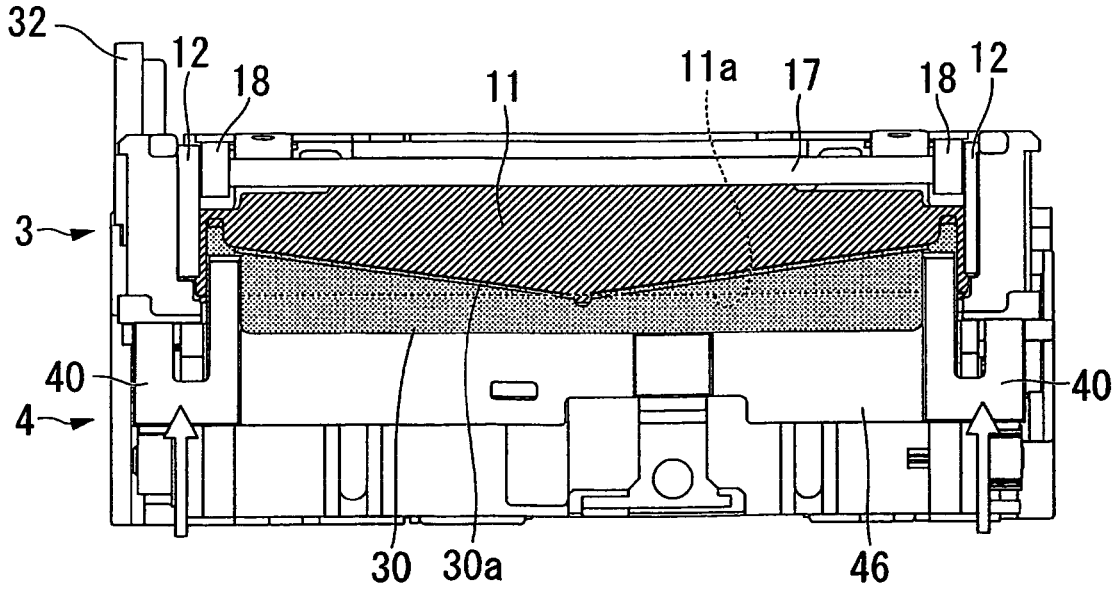
FIG. 17 is a view illustrating a state of slidably moving the movable blade from the state illustrated in FIG. 16.
Figure 18A:
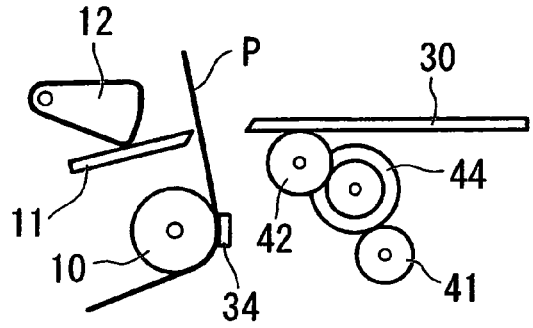
FIGS. 18A-18D are schematic views illustrating each operation state of the printer with a cutter illustrated in FIG. 1, where
Figure 18B:
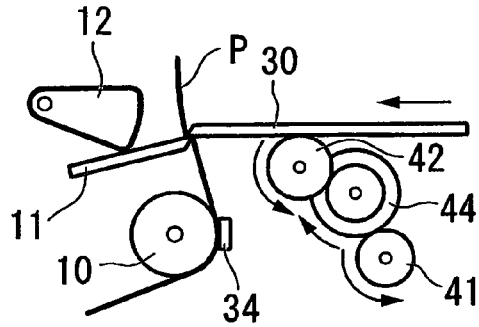

The state illustrated in FIG. 16 and FIG. 18A illustrates the state before the movable blade 30 slidably moves, and illustrates the state in which the movable blade 30 is at a predetermined position. In FIG. 16 and FIG. 17, the fixed blade 11 and the movable blade 30 are illustrated in a hatched state to facilitate the visualization of the figures.

As illustrated in FIG. 9 and FIG. 10, the slidably moved movable blade 30 rides on the upper surface of the fixed blade 11, and hence the respective cutting edges 11*a*, 30*a* overlap. The recording sheet P then can be sandwiched and cut between the fixed blade 11 and the movable blade 30. As a result, the recording sheet P wounded to the paper roll R can be used as a receipt, a ticket, and the like.

Incidentally, the fixed blade 11 is configured such that the cutting edge 11*a* can swing in a direction substantially orthogonal to the sliding direction of the movable blade 30. Further, the fixed blade 11 is biased such that the cutting edge 11*a* side is constantly lifted up by the biasing member. Thus, when the movable blade 30 rides on the upper surface of the fixed blade 11 by the slide operation, the fixed blade 11 is brought into contact with the movable blade 30 at an appropriate contacting pressure. Therefore, when cutting the recording sheet P, the fixed blade 11 and the movable blade 30 rub against each other with such contacting pressure. The recording sheet P thus can be cut with a sharp cutting edge without forming a gap between the cutting edge 11*a* of the fixed blade 11 and the cutting edge 30*a* of the movable blade 30.

Next, a case where the fixed blade 11 and the movable blade 30 bite into each other due to bite of the recording sheet P during use is described.

Figure 18C:
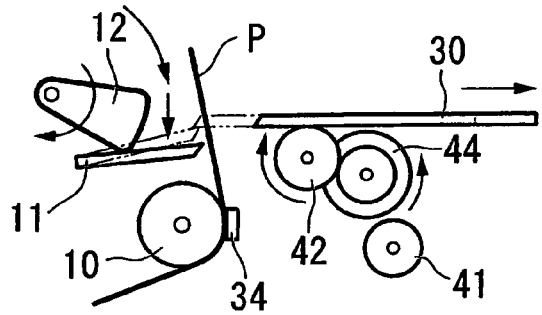
Figure 19:
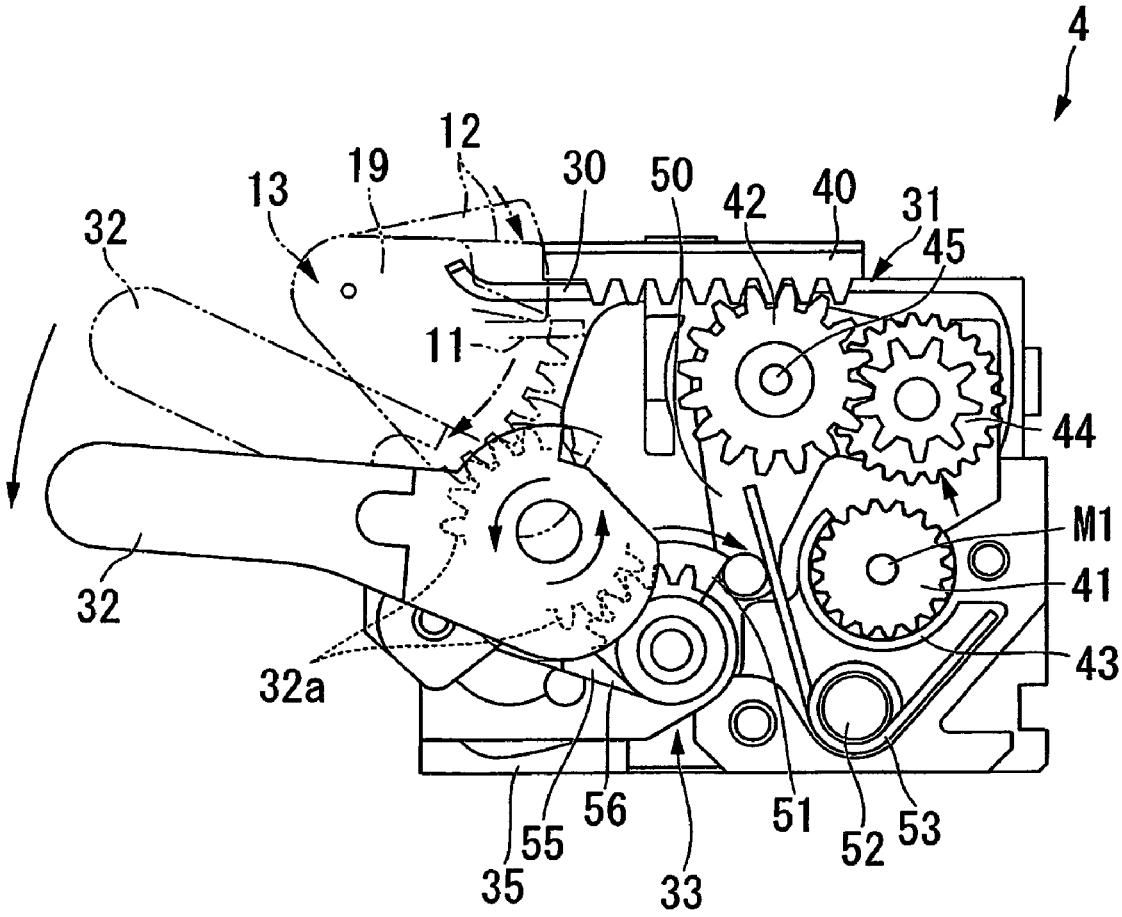
FIG. 19 is a view illustrating a state of pushing down the fixed blade by manipulating the lever portion from the state illustrated in FIG. 11, and releasing the bite of the fixed blade and the movable blade.

In this case, the lever portion 32 arranged on the main unit 4 is first push-down operated from the outer side of the casing 2. The internal gear 32*a* of the lever portion 32 then rotates, as illustrated in FIG. 19, whereby the sector gear 19 on the platen unit 3 side rotates. When the sector gear 19 rotates, the shaft 17 and the two pushing portions 12 rotate therewith. That is, the two pushing portions 12 push down the cutting edge 11*a* side of the fixed blade 11 to the lower side in conjunction with the push-down operation of the lever portion 32, as illustrated in FIG. 18C. In other words, the cutting edge 11*a* is forcibly moved in the direction of moving the fixed blade 11 away from the movable blade 30 to separate from the movable blade 30 riding on the upper surface. The contacting pressure of the movable blade 30 and the fixed blade 11, which is the cause of bite, then can be released.

In particular, even if the contacting pressure is relatively high due to paper jam, the push-down amount of the pushing portion 12 can be adjusted according to the push-down extent of the lever portion 32, and thus the movement amount of the fixed blade 11 can be adjusted, and the contacting pressure of the blades 11, 30 can be reliably released. In addition, since the pushing portion 12 is arranged at both ends of the fixed blade 11, both ends of the fixed blade 11 can be simultaneously moved to the lower side. Therefore force can be evenly transmitted to both ends of the fixed blade 11, and the fixed blade 11 can be push-down moved without tilting. The contacting pressure can be thus more reliably released.

Incidentally, when the lever portion 32 is push-down manipulated as described above, the sector gear 19 rotates by the rotation of the internal gear 32*a*, and at the same time, the release gear 56 also rotates, as illustrated in FIG. 19. The release plate 55 then rotates to the drive gear 41 side, thereby moving the pin 51 of the swinging plate 50 towards the drive gear 41 with the force against the torsion spring 53. The swinging plate 50 then rotates and moves the second gear 44 away from the drive gear 41. That is, the release mechanism 33 moves the second gear 44 geared with the drive gear 41 so as to be spaced away from the drive gear 41 in conjunction with the push-down operation of the lever portion 32. As illustrated in FIG. 18C and FIG. 19, the mechanical connection between the rack 40 and the drive gear 41 is then separated, and the movement regulation of the rack 40 is released to enter a free state.

Therefore, association with the motor is eliminated, whereby the first gear 42 and the third gear 43 can be moved irrespective of the motor. Thus, the pinion 57 rotates by the rotational biasing force by the coil spring 58, and the third gear 43 reverse rotates. The third gear 43 is coupled to the first gear 42 through an intermediation of the shaft 45, and thus the first gear 42 simultaneously reverse rotates as a result. In this case, the contacting pressure of the fixed blade 11 and the movable blade 30 is already released by the cooperative mechanism 13 on the platen unit 3 side, as described above, and hence the rack 40 moves by the reverse rotation of the first gear 42 and the third gear 43, and the movable blade 30 slidably moves to return to the predetermined position, as illustrated in FIG. 18C. That is, the movable blade 30 can automatically return to the predetermined position in a short period of time.

Figure 18D:
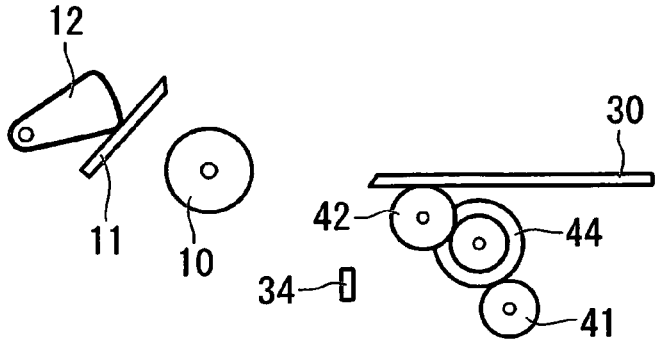

Thus, by push-down manipulating the lever portion 32, the contacting pressure of the fixed blade 11 and the movable blade 30 can be released, and the movable blade 30 can be automatically returned to the original position in a short period of time. Lastly, the lock mechanism is unlocked to open the open/close door 6. In this case, the lock shaft fitted to and locked with the lock groove 67 of the main unit 4 is also unlocked by the unlocking of the lock mechanism. Thus, when the open/close door 6 is opened, the bearing 10*a* of the platen roller 10 detaches from the fit-in hole 66 of the main unit 4, and the platen unit 3 separates from the main unit 4, as illustrated in FIG. 18D.

Therefore, it is possible to carry out appropriate response such as removing the jammed portion of the recording sheet P, which is the cause of bite, by opening the open/close door 6. The open/close door 6 is thereafter closed again so that the platen unit 3 and the main unit 4 are combined and recovered, and the process can immediately proceed to the printing task.

As described above, according to the thermal printer 1 of this embodiment, the contacting pressure between the fixed blade 11 and the movable blade 30 can be eliminated and the bite can be released with a simple method of simply push-down manipulating the lever portion 32, and thus the recovery task can be promptly carried out without imposing a burden on the worker. Further, as opposed to the related art of releasing the bite by opening the open/close cover, the bite is released through elimination of the contacting pressure of the blades 11, 30 by forcibly push-down moving the fixed blade 11 in a direction of moving away from the movable blade 30. Thus, even if the separation of the units 3, 4 is difficult due to paper jam, the bite can be reliably released. That is, the bite can be released without being influenced by the situation of paper jam.

In addition, the gearing state of the rack 40 and the first gear 42 can be simultaneously released and the movable blade 30 can automatically return to the original position with a simple method of simply push-down manipulating the lever portion 32. The recovery task thus can be easily carried out even if paper jam occurs, and the printer with enhanced convenience can be obtained. In particular, the release of the contacting pressure of the fixed blade 11 and the movable blade 30, and the automatic withdrawing operation of the movable blade 30 can be simultaneously achieved with a one-touch operation of simply push-down manipulating the lever portion 32 without opening the open/close door 6, whereby effects that cannot be obtained in the prior art can be obtained.

The thermal printer 1 also has the following effects.

That is, the movable blade 30 is arranged on the casing 2 side, and hence the recording sheet P can be cut in a more stable state, and the cut area of the recording sheet P is finished to a beautiful state. That is, if the movable blade 30 is arranged at the open/close door 6 on the separating side, the cut may become unstable due to a slight backlash and the like of the open/close door 6. Moreover, if external force is applied on the open/close door 6 in time of cutting, the instability of the cut becomes more significant. However, the movable blade 30 is arranged on the casing 2 side, and hence such possibility does not arise and cutting can be performed in a more stable state.

In addition, the structure of the main unit 4 incorporating the movable blade drive system 31 for driving the movable blade 30 and the lever portion 32 inevitably becomes more complicated compared to the platen unit 3. In this context, the main unit 4 is arranged on the casing 2 side. If the main unit 4 is arranged on the open/close door 6 side, the structure of the main unit 4 needs to be taken into consideration in addition to the open/close structure, which leads to difficulty in design because the structure itself of the open/close door 6 becomes complicated. However, the main unit 4 is arranged on the casing 2 side, and hence the configuration can be simplified. Further, the open/close door 6 becomes lighter.

Second Embodiment

The second embodiment according to the present invention is described with reference to FIG. 20 to FIG. 29. In the second embodiment, same reference symbols are denoted for the same portions as the components in the first embodiment, and the description thereof is omitted.

The second embodiment differs from the first embodiment in that, the movable blade 30 and the movable blade drive system 31 are arranged on the casing 2 side and the fixed blade 11 and the cooperative mechanism 13 are arranged on the open/close door 6 side in the first embodiment, whereas the fixed blade 11 and a cooperative mechanism 82 are arranged on the casing 2 side and the movable blade 30 and the movable blade drive system 31 are arranged on the open/close door 6 side in the second embodiment.

Figure 20:
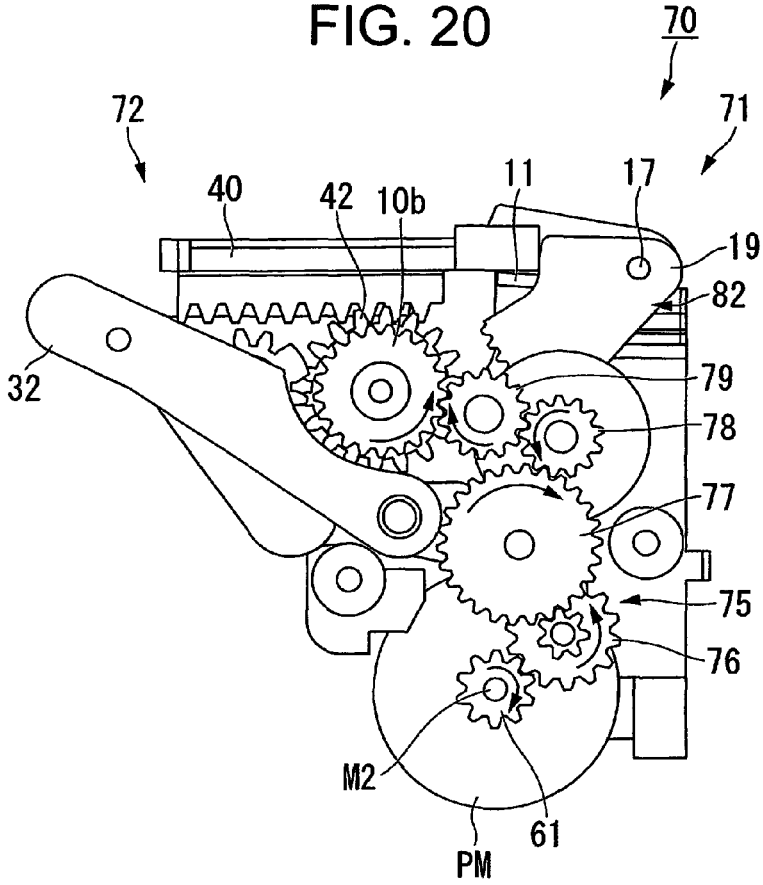
FIG. 20 is a view illustrating a printer with a cutter according to a second embodiment of the present invention, and is a side view of a state in which the main unit and the platen unit are combined.

In other words, as illustrated in FIG. 20, a thermal printer 70 of this embodiment has the fixed blade 11 and the cooperative mechanism 82 incorporated in a main unit (first unit) 71 arranged on the casing 2 side, and the movable blade 30 and the movable blade drive system 31 arranged in the platen unit (second unit) 72 arranged on the open/close door 6 side.

First, the main unit 71 is described in detail.

As illustrated in FIG. 20, the fixed blade 11 is arranged at the uppermost part of the main unit 71, and the lever portion 32, the platen motor PM, the platen drive gear 61, and the platen gear train 75 are arranged on one side surface side of the main unit 71.

The platen motor PM is arranged at the lowermost part of the main unit 71, and the platen drive gear 61 is coupled to the drive shaft M2 of the motor PM. The platen gear train 75 includes a tenth gear 76 geared with the platen drive gear 61, an eleventh gear 77 geared with the tenth gear 76, a twelfth gear 78 geared with the eleventh gear 77, and a thirteenth gear 79 geared with the twelfth gear 78 and the driven gear **10*b* on the platen unit 72** side.

Figure 21:
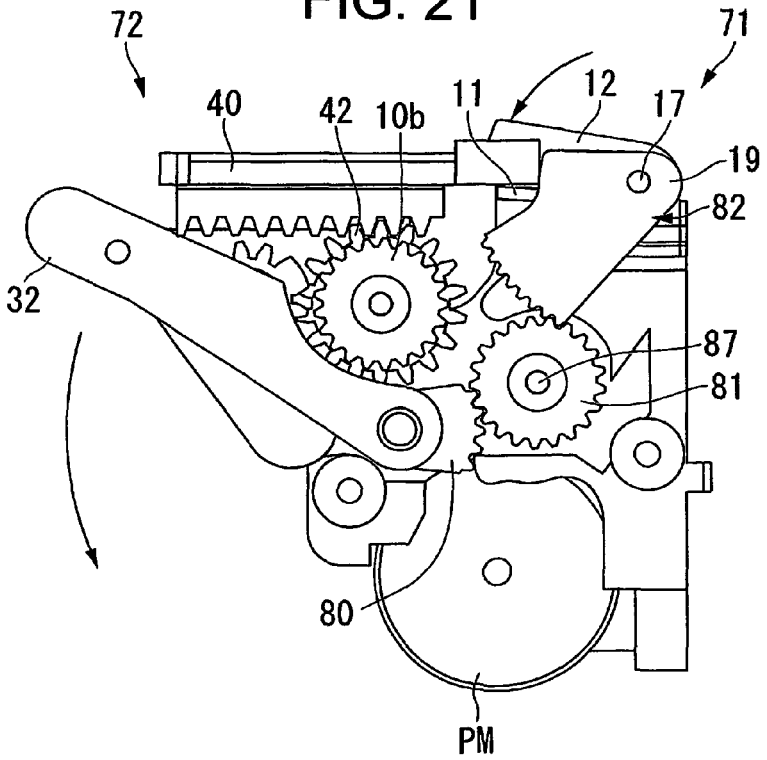
FIG. 21 is a view illustrating a state in which some gears are detached from the state illustrated in FIG. 20.

As illustrated in FIG. 21, a gear plate 80 that rotates with the push-down operation is attached to the lever portion 32. The release gear 81 is geared with the gear plate 80. The sector gear 19 coupled to the shaft 17 is geared to the release gear 81. Two pushing portions 12 positioned at both ends of the fixed blade 11 are coupled to the shaft 17. The gear plate 80, the release gear 81, and the sector gear 19 are arranged on the inner side than the platen gear train 75.

According to such configuration, when the lever portion 32 is push-down manipulated, the sector gear 19 rotates through the intermediation of the gear plate 80 and the release gear 81, and the two pushing portions 12 push-down move the fixed blade 11 in the direction of moving away from the movable blade 30, thereby releasing the contacting pressure of the blades 11, 30. In other words, in this embodiment, the gear plate 80, the release gear 81, the two pushing portions 12, the shaft 17 and the sector gear 19 function as the cooperative mechanism 82.

As illustrated in FIG. 22A, a forward/reverse rotatable motor M for slidably moving the movable blade 30 is arranged at the lowermost part on the other side surface side of the main unit 71. The drive gear 41 is coupled to the drive shaft M1 of the motor. A transmission gear 83 that gears with the drive gear 41 and the third gear 43 serving as the rack gear on the platen unit 72 side is arranged above the drive gear 41. The third gear 43 is geared with the pinion 57 incorporating the coil spring 58, as illustrated in FIG. 22B.

Figure 23:
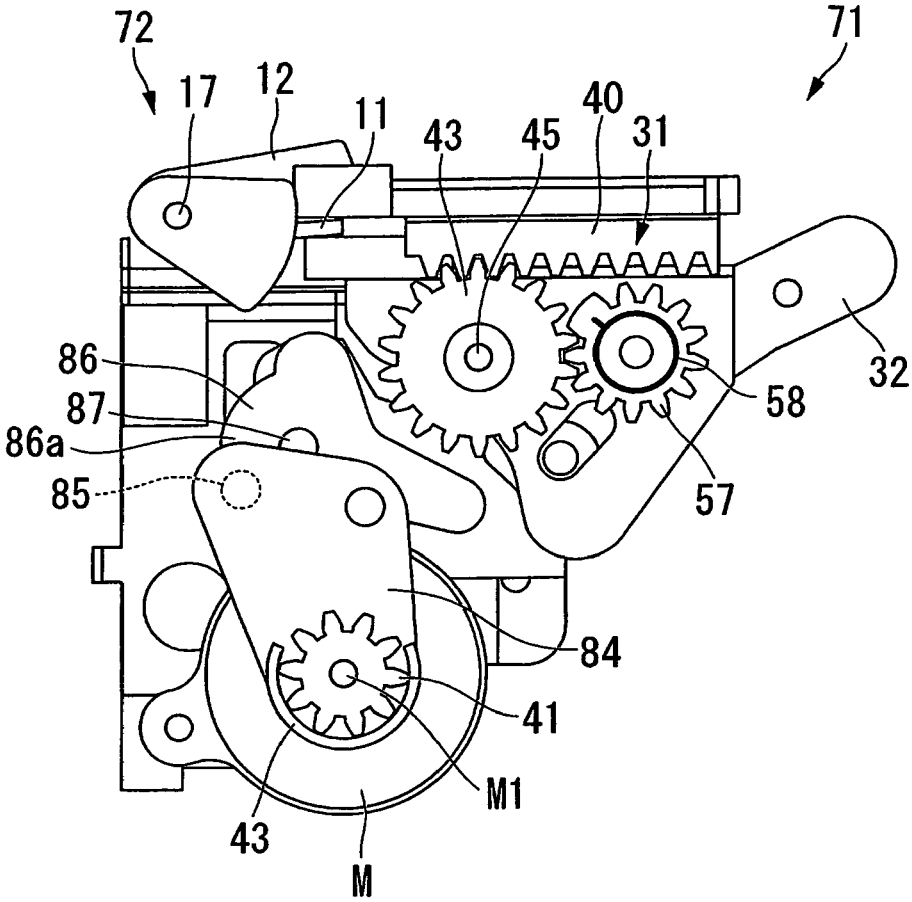
FIG. 23 is a view illustrating a state in which the transmission gear is detached from the state illustrated in FIG. 22A.
Figure 24:
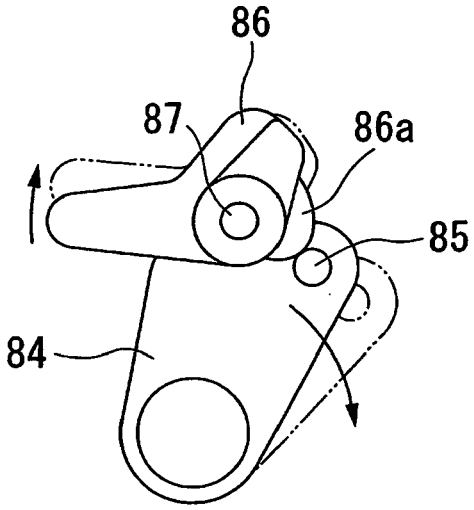
FIG. 24 is a view of the swinging plate and the cam plate illustrated in FIG. 23 seen from the back surface.

As illustrated in FIG. 23, the transmission gear 83 is rotatably supported by the swinging plate 84 supported in a freely rotating manner at the drive shaft M1 of the motor M. Therefore, when the swinging plate 84 is swung, the transmission gear 83 also moves therewith. As illustrated in FIG. 24, a projection pin 85 is formed on the inner surface of the swinging plate 84.

Figure 25:
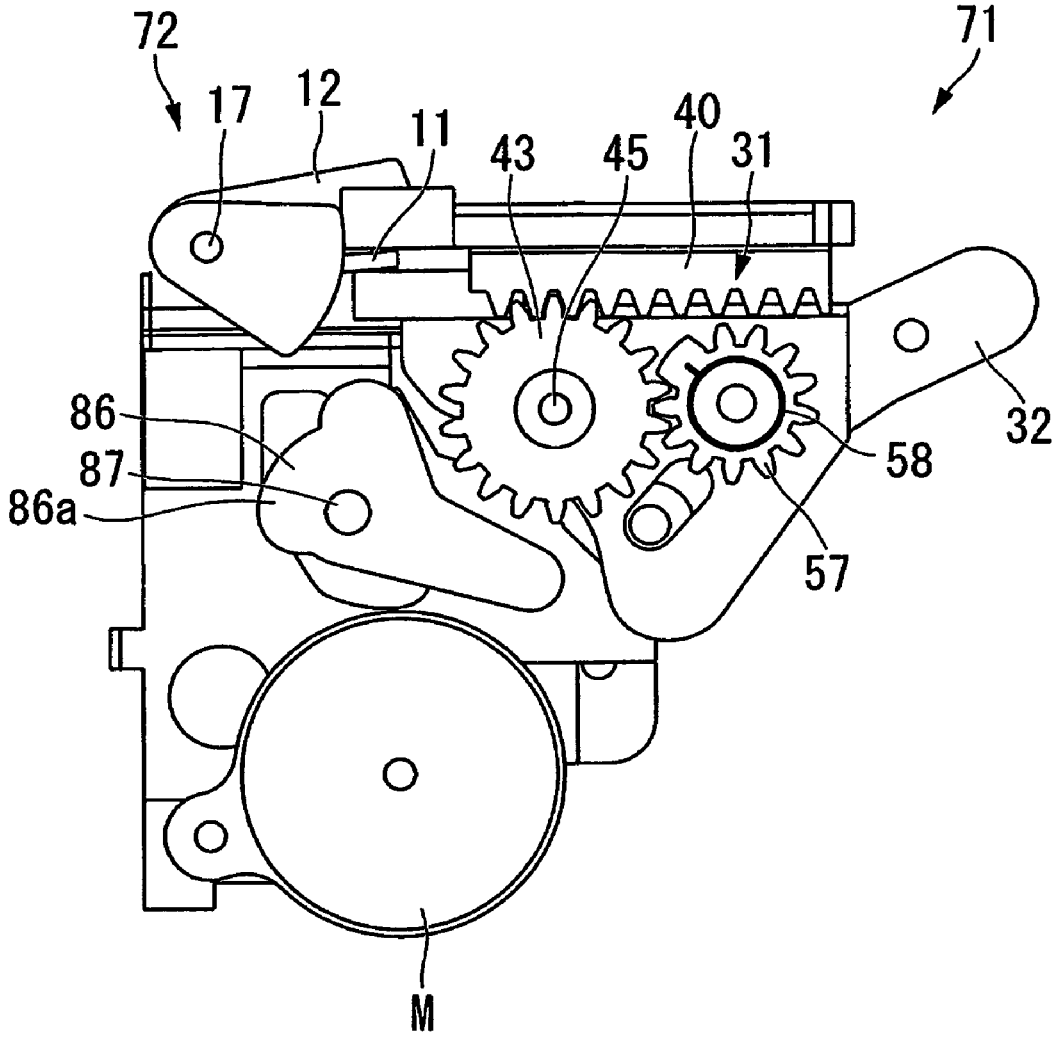
FIG. 25 is a view illustrating a state in which the swinging plate is detached from the state illustrated in FIG. 23.

As illustrated in FIG. 25, a cam plate 86 having a cam portion **86*a* formed to a cam-shape is arranged on the inner side of the swinging plate 84. The cam plate 86 is coupled to the release gear 81 on the opposite side through an intermediation of the shaft 87 so as to rotate with the rotation of the release gear 81. That is, the cam plate 86 rotates with the push-down operation of the lever portion 32. The cam portion 86*a* of the cam plate 86 is held in contact with the projection pin 85 of the swinging plate 84, as illustrated in FIG. 24. In this case, when the cam plate 86 rotates by the push-down manipulation of the lever portion 32, the position of the projection pin 85 and the position of the cam portion 86*a* are adjusted such that the swinging plate 84 rotates in the direction the transmission gear moves away from the third gear 43 on the platen unit 72** side.

The transmission gear 83 and the third gear 43 can separate in conjunction with the push-down operation of the lever portion 32, and consequently, the mechanical connection of the rack 40 and the drive gear 41 is separated, thereby releasing the movement regulation of the rack 40. That is, in this embodiment, the release gear 81, the cam plate 86, the swinging plate 84, and the transmission gear 83 function as the release mechanism 88.

Next, the platen unit 72 is described.

As illustrated in FIG. 20 and FIG. 22A, the movable blade 30 and the rack 40 supported by the support plate 46 are arranged at the uppermost part of the platen unit 72. The rack 40 is geared with the first gear 42 and the third gear 43. When platen unit 72 and the main unit 71 are combined, the first gear 42 is arranged on one side surface side (lever portion 32 side) of the main unit 71, and the third gear 43 is arranged on the other side surface side (transmission gear 83 side). The third gear 43 and the transmission gear 83 are also in a geared state.

Further, the driven gear 10*b* coupled to the bearing 10*a* of the platen roller 10 is arranged while being overlapped with the first gear 42 so as to rotate at the same rotation shaft as the first gear 42. The first gear 42 and the driven gear 10*b* are separately rotatable. When the platen unit 72 and the main unit 71 are combined, the driven gear 10*b* gears with the thirteenth gear 79 of the platen gear 75 on the main unit 71 side.

According to the thermal printer 70 configured as described above, when rotating the platen roller 10, the platen motor PM is driven to rotate the platen drive gear 61, as illustrated in FIG. 20. The rotational force is then transmitted to the driven gear 10*b* through the platen gear train 75. The platen roller 10 then can be rotated.

Further, as illustrated in FIG. 22A, when cutting the recording sheet P, the motor M is driven to rotate the drive gear 41. The rotational force is transmitted to the third gear 43 through the transmission gear 83, and thus the third gear 43 rotates or at the same time, the first gear 42 coupled to the third gear 43 through an intermediation of the shaft 45 rotates. The rack 40 geared to the first gear 42 and the third gear 43 linearly moves. The movable blade 30 then can be slidably moved towards the fixed blade 11 to thereby cut the recording sheet P.

Next, a case where the fixed blade 11 and the movable blade 30 are bitten due to paper jam of the recording sheet P during use is described below.

Figure 26A:
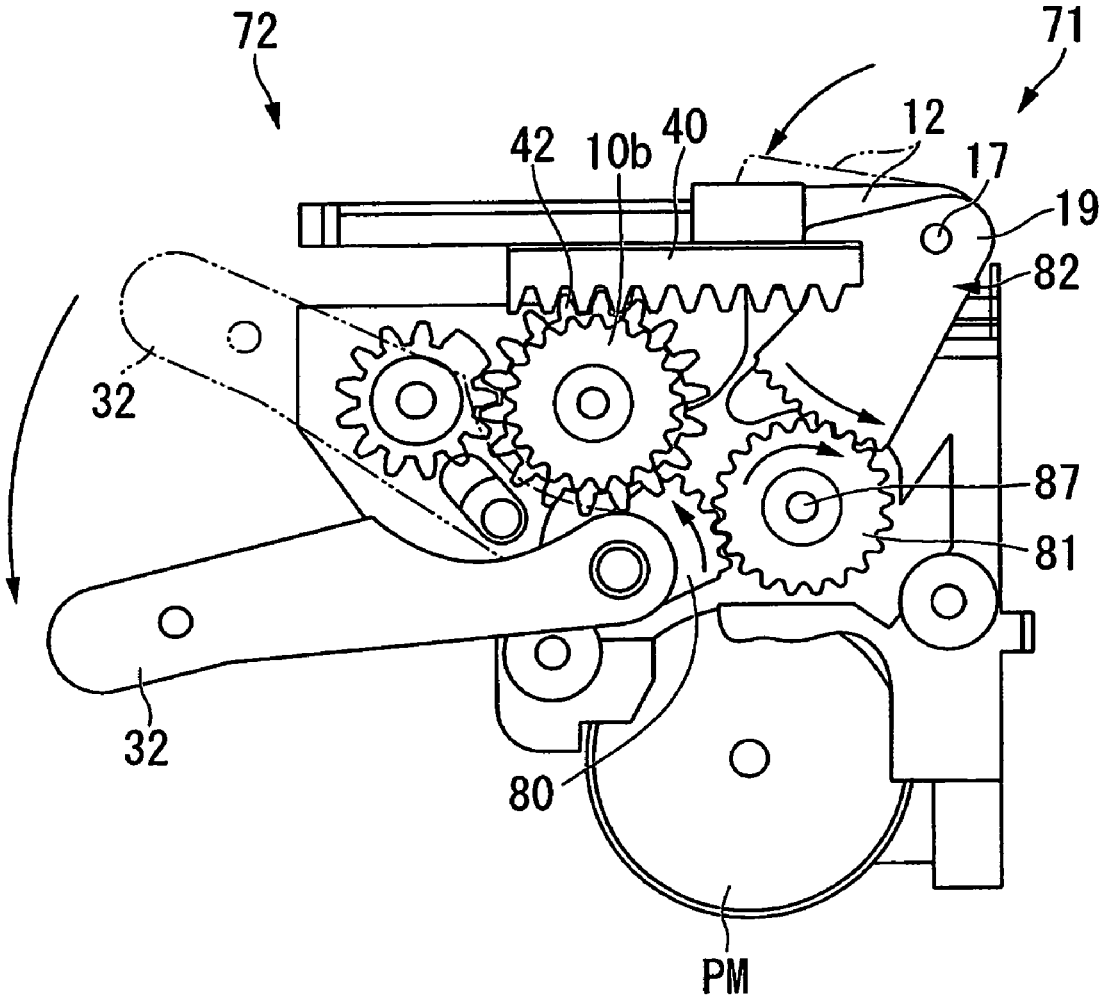
FIG. 26A is a view illustrating a state of push-down manipulating the lever portion from the state illustrated in FIG. 21.
Figure 26B:
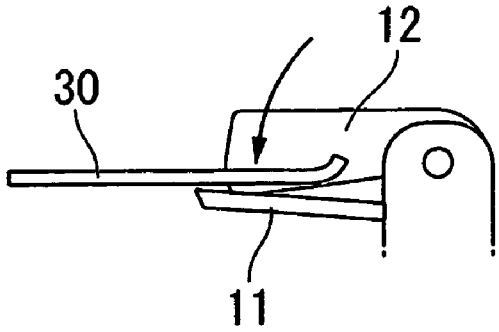
FIG. 26B is a view illustrating a state in which the pushing portion pushes down the fixed blade by the push-down manipulation of the lever portion.

In this case, as illustrated in FIG. 26A, the lever portion 32 arranged at the main unit 71 is first push-down manipulated. The gear plate 80 and the release gear 81 attached to the lever portion 32 then rotate. When the release gear 81 rotates, the sector gear 19 rotates. When the sector gear 19 rotates, the shaft 17 and the two pushing portions 12 rotate therewith. That is, as illustrated in FIG. 26B, the two pushing portions 12 push down the cutting edge 11*a* side of the fixed blade 11 downward in conjunction with the push-down operation of the lever portion 32. The fixed blade 11 then can be forcibly push-down moved in the direction of moving away from the movable blade 30 so as to separate from the movable blade 30 riding on the upper surface, and the contacting pressure of the movable blade 30 and the fixed blade 11, which is the cause of bite, can be released.

Figure 27:
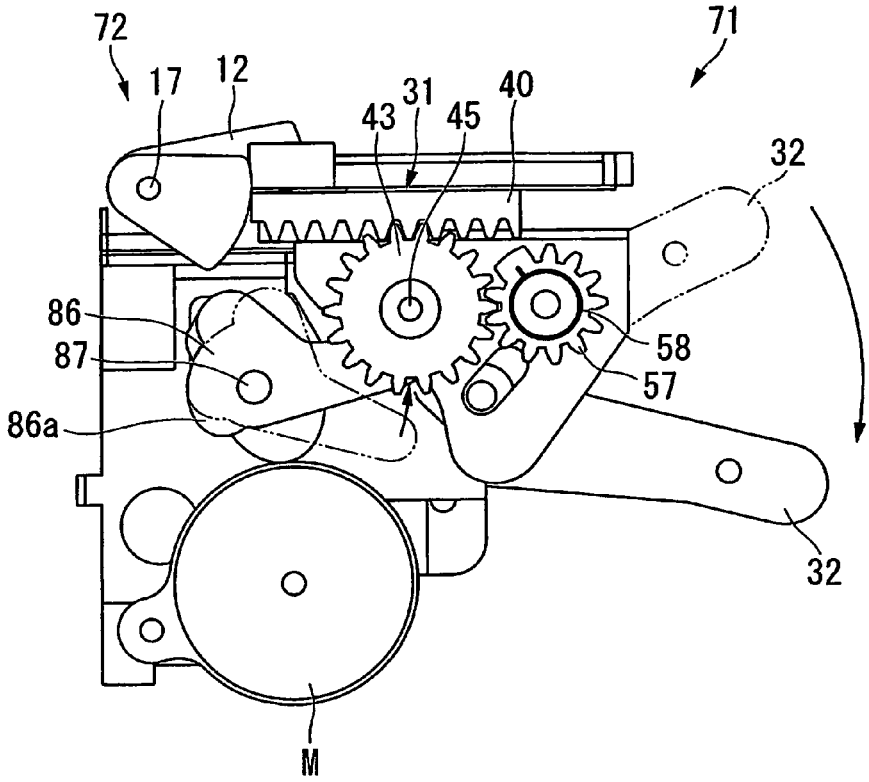
FIG. 27 is a view illustrating a state in which the cam plate is rotated by push-down manipulating the lever portion from the state illustrated in FIG. 25.
Figure 28:
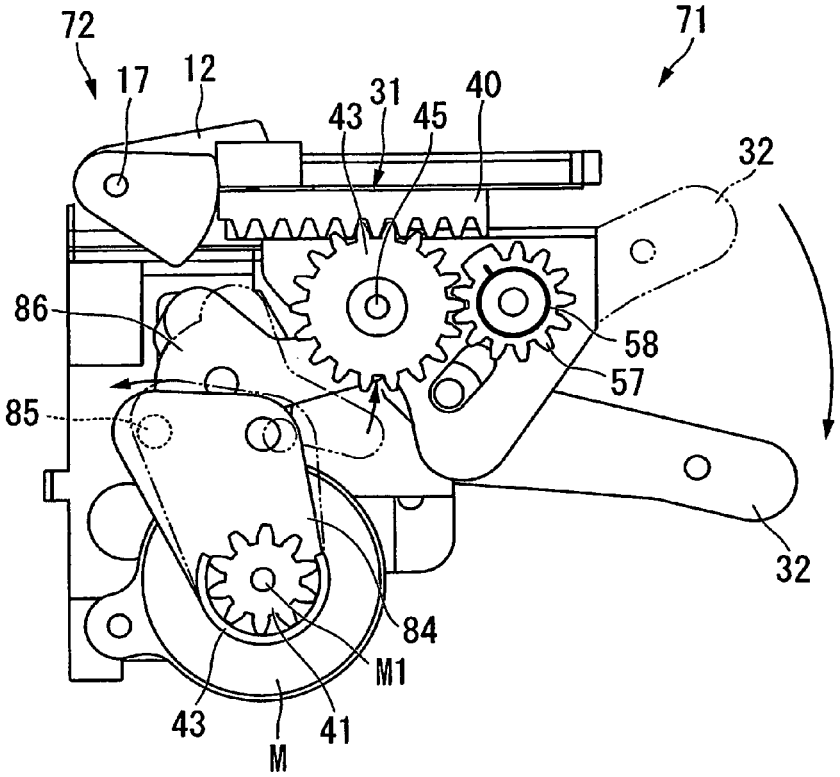
FIG. 28 is a view illustrating a state in which the swinging plate is rotated by the rotation of the cam plate illustrated in FIG. 27.
Figure 29:
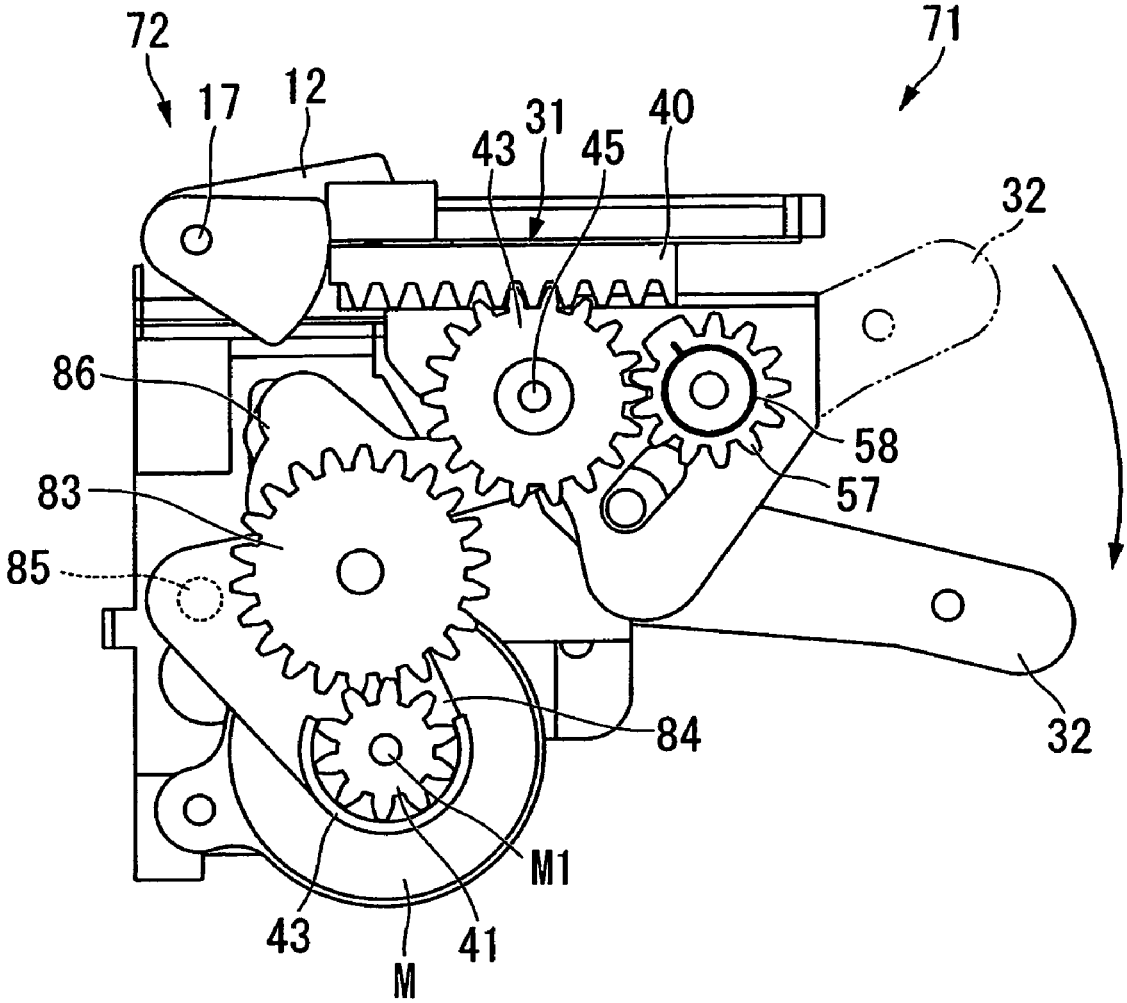
FIG. 29 is a view illustrating a state in which the geared state of the transmission gear and the third gear is released by the rotation of the swinging plate illustrated in FIG. 28.
Figure 30A:
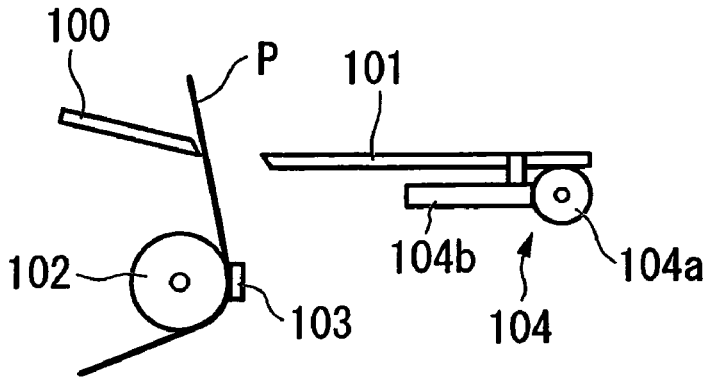
FIG. 30A PRIOR ART
FIGS. 30A-30C are a view illustrating one example of releasing the bite of the fixed blade and the movable blade of the related art.
Figure 30B:
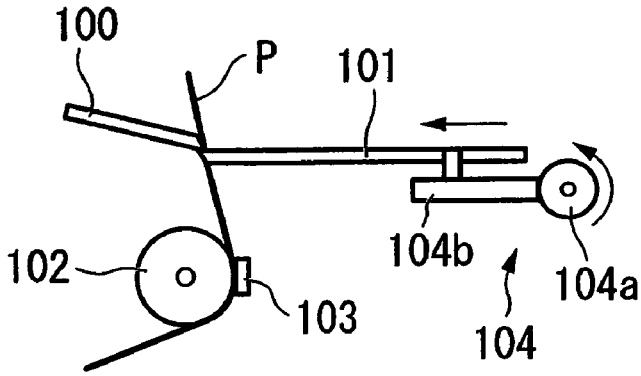
FIG. 30B PRIOR ART
Figure 30C:
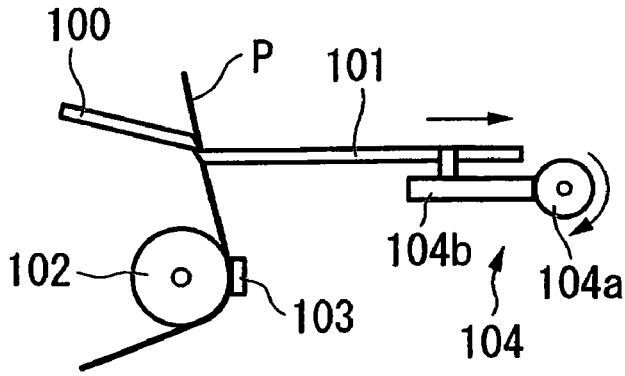
FIG. 30C PRIOR ART
Figure 31A:
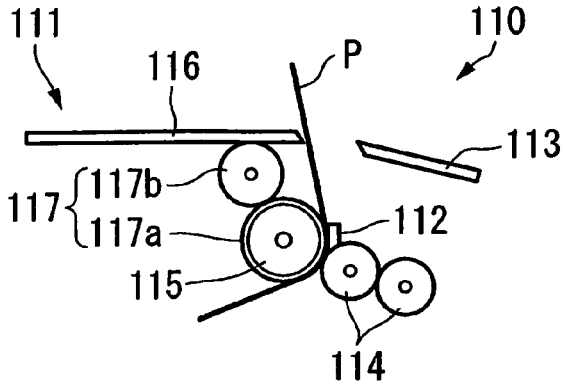
FIG. 31A PRIOR ART
FIG. 31 is a view illustrating another example of releasing the bite of the fixed blade and the movable blade of the related art.
Figure 31B:
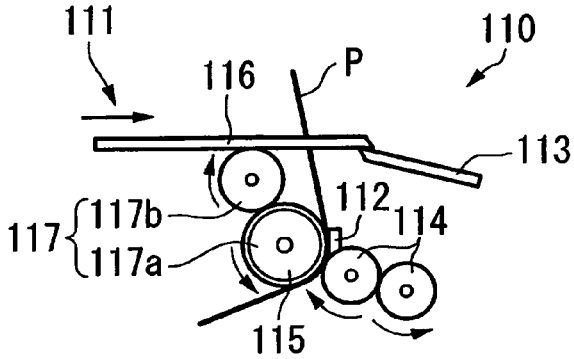
FIG. 31B PRIOR ART
Figure 31C:
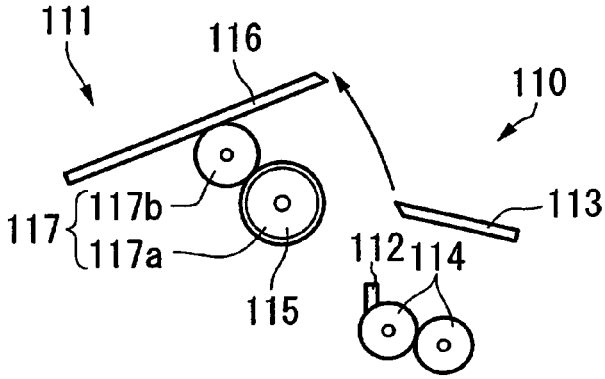
FIG. 31C PRIOR ART
Figure 31D:
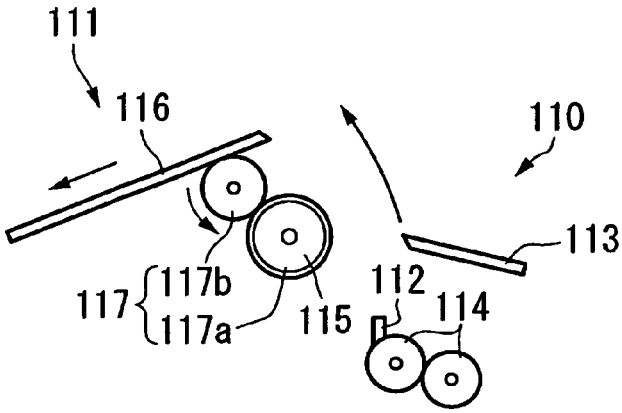
FIG. 31D PRIOR ART

Meanwhile, at the same time as when the release gear 81 rotates, the cam plate 86 rotates as illustrated in FIG. 27. The cam portion 86*a* then rotates, thereby moving the projection pin 85. Accordingly, as illustrated in FIG. 28, the swinging plate 84 rotates and moves the transmission gear 83 away from the third gear 43 on the platen unit 72 side. Thus, as illustrated in FIG. 29, the transmission gear 83 and the third gear 43 can move away in conjunction with the pushing down of the lever portion 32, and consequently, the mechanical connection of the drive gear 41 and the rack 40 can be separated. The movement regulation of the rack 40 is thereby released to enter a free state.

Therefore, association with the motor is eliminated, whereby the first gear 42 and the third gear 43 can be moved irrespective of the motor. Thus, the pinion 57 rotates by the rotational biasing force by the coil spring 58, and the first gear 42 reversely rotates and at the same time the third gear 43 also reversely rotates. As a result, the movable blade 30 can slidably move to return to the predetermined position, and the movable blade 30 can automatically return to the predetermined position in a short period of time.

As described above, even in the thermal printer 70 of this embodiment, by push-down manipulating the lever portion 32, the contacting pressure of the fixed blade 11 and the movable blade 30 can be released, and the movable blade 30 can be automatically returned to the original position in a short period of time, similar to the first embodiment. That is, similar operational effects can be obtained even if the movable blade 30 is arranged on the open/close door 6 side, and the fixed blade 11 is arranged on the casing 2 side.

The technical scope of the present invention is not limited to the above-mentioned embodiments, and various modifications may be made without departing from the gist of the present invention.

For instance, in each embodiment described above, the thermal printer has been described as one example of the printer with a cutter, but it is not limited to the thermal printer. For instance, it may be an inkjet printer, having the thermal head as the inkjet head, for printing on the pulled out recording sheet using ink droplets.

While the thermal printer having the open/close door on the upper surface of the casing has been described, the design may be made such that the open/close door is arranged to the front surface of the casing, and hence the printed recording sheet is discharged from the front surface side. A drop-in type thermal printer of simply placing the paper roll and mounting it on the mounting board has been described, but it is not limited to such type, and may be an axial-supporting type thermal printer in which an axially supporting mechanism for axially supporting (rotatably supporting) the paper roll is arranged in the interior of the casing.

In the first embodiment, the mechanical connection between the rack 40 and the drive gear 41 is separated by releasing the geared state of the drive gear 41 and the second gear 44, but it is not limited thereto. Any configuration may be adopted as long as the mechanical connection of the rack 40 and the drive gear 41 can be separated. Similarly, in the second embodiment, the mechanical connection of the rack 40 and the drive gear 41 is separated by releasing the geared state of the transmission gear 83 and the third gear 43, but it is not limited thereto. Any configuration may be adopted as long as the mechanical connection of the rack 40 and the drive gear 41 can be separated.

In each embodiment described above, the pinion incorporating the coil spring is geared with the third gear serving as the rack gear, and the movable blade is automatically returned to the original position using the force of the coil spring, but the coil spring may not be used. That is, the movable blade may be manually returned to the original position when the mechanical connection of the third gear and the drive gear is separated by the release mechanism.

In each embodiment described above, a thermal printer of a type in which the main unit and the platen unit are separated in accordance with the opening/closing of the open/close door has been described, but it is not limited to such case, and may be a type (fixed slide cutter) in which the main unit and the platen unit do not separate. In this case as well, the main object of the present invention to release the bite of the fixed blade and the movable blade without changing the positional relationship of both units can be achieved.

What is claimed is:

1. A printer with a cutter, for performing printing on a recording sheet pulled out from a paper roll, and then cutting the recording sheet, comprising:

a fixed blade arranged so as to face the pulled out recording sheet;

a movable blade slidably arranged with respect to the fixed blade and riding on an upper surface of the fixed blade when sliding, for sandwiching and cutting the pulled out recording sheet together with the fixed blade;

a movable blade drive system having a rack attached to the movable blade, and a rack gear which gears with the rack, rotates in accordance with rotation of a drive gear coupled to a forward/reverse rotatable motor, and linearly moves the rack;

a manipulatable lever portion;

a cooperative mechanism having a pushing portion for moving the fixed blade in a direction of moving away from the movable blade in conjunction with manipulation of the lever portion, and for releasing a contacting pressure of the fixed blade and the movable blade;

a first unit incorporating the fixed blade and the cooperative mechanism; and a second unit incorporating the movable blade and the movable blade drive system, and being combined with respect to the first unit, wherein one of the first unit and the second unit is separable from the other of the first unit and the second unit, and the combination is released.

2. A printer with a cutter according to claim 1, wherein:

the second unit is arranged in a casing; and the first unit is arranged at an open/close door fixed to the casing in an openable/closable manner, and is separable from the second unit.

3. A printer with a cutter according to claim 2, wherein the pushing portion is arranged at both ends of the fixed blade so as to simultaneously move the both ends.

4. A printer with a cutter according to claim 3, further comprising a release mechanism for separating a mechanical connection of the rack and the drive gear in conjunction with the manipulation of the lever portion, and for releasing a movement regulation of the rack.

5. A printer with a cutter according to claim 4, further comprising a biasing member for biasing and moving the movable blade so as to return the movable blade to a predetermined position when the movement regulation of the rack is released.

6. A printer with a cutter according to claim 2, further comprising a release mechanism for separating a mechanical connection of the rack and the drive gear in conjunction with the manipulation of the lever portion, and for releasing a movement regulation of the rack.

7. A printer with a cutter according to claim 6, further comprising a biasing member for biasing and moving the movable blade so as to return the movable blade to a predetermined position when the movement regulation of the rack is released.

8. A printer with a cutter according to claim 1, wherein the pushing portion is arranged at both ends of the fixed blade so as to simultaneously move the both ends.

9. A printer with a cutter according to claim 8, further comprising a release mechanism for separating a mechanical connection of the rack and the drive gear in conjunction with the manipulation of the lever portion, and for releasing a movement regulation of the rack.

10. A printer with a cutter according to claim 9, further comprising a biasing member for biasing and moving the movable blade so as to return the movable blade to a predetermined position when the movement regulation of the rack is released.

11. A printer with a cutter according to claim 1, further comprising a release mechanism for separating a mechanical connection of the rack and the drive gear in conjunction with the manipulation of the lever portion, and for releasing a movement regulation of the rack.

12. A printer with a cutter according to claim 11, further comprising a biasing member for biasing and moving the movable blade so as to return the movable blade to a predetermined position when the movement regulation of the rack is released.

* * * * *